US005924784A

United States Patent [19]

Chliwnyj et al.

[11] Patent Number: 5,924,784

[45] Date of Patent: Jul. 20, 1999

[54] MICROPROCESSOR BASED SIMULATED ELECTRONIC FLAME

[76] Inventors: Alex Chliwnyj; Tanya D. Chliwnyj, both of 6380 N. Yuma Mine Rd., Tucson, Ariz. 85743

[21] Appl. No.: 08/698,042

[22] Filed: Aug. 15, 1996

Related U.S. Application Data

[60] Provisional application No. 60/002,547, Aug. 21, 1995.

[51] Int. Cl.[6] ..... F21V 33/00; H05B 37/04

[52] U.S. Cl. ..... 362/234; 362/253; 362/184; 362/154; 52/128; 52/133; 315/86; 315/324; 307/64

[58] Field of Search ..... 52/103, 104, 128, 52/129, 130, 131, 132, 133, 134; 362/251, 183, 191, 802, 121, 807, 132, 184, 806, 800, 307, 310, 311, 145, 153, 153.1, 190, 234, 154, 253; 40/428; 307/48, 64; 315/86, 324, 323, 294, 224, 56, 58, 71

[56] References Cited

U.S. PATENT DOCUMENTS

| | | | |
|---|---|---|---|
| 1,794,109 | 2/1931 | Eckert | 362/132 |
| 2,240,334 | 4/1941 | Kayatt | 362/806 |
| 2,427,655 | 9/1947 | Blankenship | 362/35 |
| 3,710,182 | 1/1973 | Van Reenen | 315/199 |
| 4,324,026 | 4/1982 | Craft | 27/1 |
| 4,383,244 | 5/1983 | Knauff | 340/321 |
| 4,453,201 | 6/1984 | Prouty | 362/311 |
| 4,492,896 | 1/1985 | Jullien | 315/153 |
| 4,510,556 | 4/1985 | Johnson | 362/184 |
| 4,605,882 | 8/1986 | DeLuca | 315/158 |
| 4,777,408 | 10/1988 | DeLuca | 315/158 |
| 4,839,780 | 6/1989 | Chuan et al. | 362/265 |
| 4,866,580 | 9/1989 | Blackerby | 362/802 |
| 4,870,325 | 9/1989 | Kazar | 315/178 |
| 5,013,972 | 5/1991 | Malkieli et al. | 315/209 R |
| 5,030,890 | 7/1991 | Johnson | 315/208 |
| 5,097,180 | 3/1992 | Ignon et al. | 315/200 A |

(List continued on next page.)

OTHER PUBLICATIONS

Biodan & LP, Inc. Advertisement, New York and Toronto.

Hewlett Packard, "High Power AlINGaP Amber and Reddish–Orange Lamps", Technical Data, pp. 3–24 –3–29.

Andreycak, B., "Elegantly Simple Off–Line Bias Supply for Very Low Power Applictions", Application Note U–149, pp. 1–11, Integrated Circuits, Unitrode Corporation, 1994.

"Off–line Power Supply Controller", pp. 1–6, Integrated Circits, Unitrode, Feb. 1995.

*Primary Examiner*—Laura Tso

*Attorney, Agent, or Firm*—Robert Platt Bell & Associates, P.C.

[57] ABSTRACT

Electronic lighting devices that simulate a realistic flame are disclosed. The preferred embodiment has a plurality of lighting elements in a plurality of colors which are modulated in intensity by a control circuit with a stored program. The control program includes stored amplitude waveforms for the generation of a realistic flame simulation. The program further contains random elements to keep the flame constantly changing. The control circuit has built in power management functions that can control the mean intensity of the simulated flame based on some power management budget with the ability to measure the charge/discharge duration of the power source, when used with a rechargeable power source. The currents to the individual lighting elements are selectable from a set of discrete quantization values. Tables of amplitude modulated time waveforms are stored in the microprocessor memory, from which the real time control data streams for the individual lighting elements are synthesized. By using these stored waveforms many different flame modes can be simulated. Effects such as a random gust of wind and other disturbances are inserted into the flame simulation from time to time. After a simulated disturbance the simulated flame settles back into more of a steady state condition just like a real flame does. The net result is that the simulated flame is a slowly changing series of patterns resulting in soothing and calming effects upon the viewer.

47 Claims, 12 Drawing Sheets

U.S. PATENT DOCUMENTS

| | | | |
|---|---|---|---|
| 5,174,645 | 12/1992 | Chung | 362/86 |
| 5,252,893 | 10/1993 | Chacham et al. | 362/183 |
| 5,255,170 | 10/1993 | Plamp et al. | 362/183 |
| 5,264,761 | 11/1993 | Johnson | 315/291 |
| 5,294,865 | 3/1994 | Haraden | 315/58 |
| 5,317,238 | 5/1994 | Schaedel | 315/323 |
| 5,379,200 | 1/1995 | Echard | 362/183 |
| 5,463,280 | 10/1995 | Johnson | 315/187 |
| 5,564,816 | 10/1996 | Arcadia et al. | 362/191 |
| 5,575,459 | 11/1996 | Anderson | 362/800 |
| 5,655,830 | 8/1997 | Ruskouski | 362/800 |

MICROPROCESSOR BASED SIMULATED ELECTRONIC FLAME

CROSS-REFERENCE TO RELATED APPLICATIONS

This application claims priority from Provisional U.S. Application Ser. No. 60/002,547, filed Aug. 21, 1995 and incorporated herein by reference.

FIELD OF THE INVENTION

The invention described herein is related generally to electrical lighting apparatuses, and is related more specifically to decorative electrical lighting devices which simulate candles or other natural flames.

BACKGROUND OF THE INVENTION

There are a number of previously known lighting devices which are designed to simulate flames or candles. An example of a simple gas discharge lamp with parallel plates involves no electronics. In this system the neon gas glows with an orange color and the light bulb flickers. This suffers from a low light output as well as a rapid unrealistic flicker effect, as it is difficult to control the flicker rate.

U.S. Pat. No. 4,839,780, issued to Chuan et al., teaches a simulative candle involving an electric neon bulb powered by an astable DC-to-DC power supply which causes the bulb to flicker.

Another example of electrically-simulated candle flames uses incandescent lamps. The lamps can have one or more filaments that are caused to glow with some manner of modulation or flickering.

U.S. Pat. No. 5,097,180, issued to Ignon et al., teaches a flickering candle lamp which uses multiple independent analog oscillators with the weighted outputs summed together to cause the filament of a single electric bulb to flicker.

U.S. Pat. No. 4,510,556, issued to Johnson, teaches an electronic candle apparatus using a digital shift register to create pseudo-random pulse trains to drive a set of 3 vertically spaced lamps producing varying average brightness: The bulb at the bottom is the brightest and the bulb at the top has the least average brightness.

U.S. Pat. No. 4,492,896, issued to Jullien, teaches a coin operated electronic candle system comprising an array of simulated candles, each of which uses a light bulb with a single filament that is caused to flicker.

These last inventions use incandescent light bulbs which require high power and give off heat. The life of the bulb is shortened by the heating and cooling of the filament caused by the on and off flickering. The single filament devices also suffer from a lack of motion in the simulated flame.

Other known electronically simulated candles use light emitting diodes (LEDs) in place of lamps. For example, U.S. Pat. No. 5,013,972, issued to Malkieli et al., teaches a dual-powered flickering light which use a flip flop or multivibrator to alternately pulse a pair of light emitting diodes on and off to simulate a candle flame.

U.S. Pat. No. 5,255,170, issued to Plamp et al., teaches an illuminated memorial comprising a lucite cross for continuous illumination at night using a single red LED, which is powered by rechargeable batteries. The batteries are rechargeable with a solar cell.

Other devices use LEDs that are flashing to simulate electronic candles. The LEDs are typically of a single color, and use repetitive and very limited simulated pattern.

The discussed prior-art electronic flame or candle simulations cover a range of known approaches to electronic simulation of flames or candles. The utilized circuits, some having a simulated flicker, typically result in a flame simulation that appears static or repetitive after a very short time of observation due to the limited pattern length and the lack of variety. The prior-art flame or candle simulations may not be relaxing or soothing to a viewer because of their fatiguing viewing patterns.

Even with multiple lighting elements, prior art flame or candle simulations fail to realistically simulate the randomness of a flame, especially when viewed over a length of time. Some of these previously known devices rely on a "flicker" effect by pseudo-randomly turning on and off the lighting elements. This known simulation approach typically yields flickers with a noticeable repetitive pattern. The devices also typically suffer from a limited number of discrete intensity levels, with some having as few as two, on and off. Yet, other devices which use an analog circuitry often suffer from an absence of flicker randomness.

What is then needed is an electronic flame or candle simulation with time-changing simulated flame patterns, possibly including color patterns, to better engender soothing and visually pleasing lighting effects.

SUMMARY AND OBJECTS OF THE INVENTION

A microprocessor-based simulated electronic flame uses multiple LEDs that are controlled to give the appearance of flame motion, typically when viewed through a diffuser. It is the plurality of lights that allows simulated flame motion. Additionally the use of a plurality of colors also enhances the effect of motion.

With the microprocessor-based flame simulation, brightness of the simulated flame may be enhanced. Pulse width modulation of LED currents tends to broaden the spectrum of the LEDs. This leads to an increased apparent brightness of the flame. Super Brite™ light emitting diodes (Super Brite™ LEDs), which may be supplied by high-power AlInGaP amber and reddish-range LED lamps, have a wider spectrum than other LEDs. Super Brite™ LEDs may also enhance the flame motion due to color changes.

The microprocessor operation allows precise control of the simulation without the typical tolerances found in an analog implementation. Among other effects, the simulated flame avoids the typical jarring or unpleasant visual effects that can arise from beat frequencies such as those found in a system using independent oscillators summed together. By using a microprocessor the flame simulation may appear to be a natural random process, not achievable by a simple analog circuitry. A controlled complete simulation achieves some very pleasing, soothing, and almost mesmerizing visual effects.

The objects of the invention are described below. The specific embodiments of the invention may incorporate one or more of electrical power sources, including a rechargeable power source.

The general object and purpose of the present invention is to provide new and improved decorative lighting devices, each capable of simulating changing flame patterns, which flame patterns differ from simply repetitive flickering, to engender comfortable and soothing visual effects to a viewer.

Another object of the present invention is to provide a flame simulation which may have a variety of decorative, memorial, and ornamental lighting applications, the principal applications being in memorial and religious applications.

Another object of the present invention is to provide a flame simulation ranging from a small simulated candle to a full fireplace-sized simulated fire, with many possible variations in between.

Another object of the present invention is to provide a flame simulation which may derive its electric power from certain alternative power sources; e.g., AC, DC, battery, and/or solar rechargeable power sources.

Another object of the present invention is to provide a flame simulation by modulating the intensity of the Super Brite™ light emitting diodes, which may be supplied by high-power AlInGaP amber and reddish-range LED lamps.

Another object of the present invention is to provide a flame simulation with the use of a pulse width modulation (PWM) technology to turn LEDs on and off at a frequency that is far above the ability of the human eye to resolve. The use of PWM is an economical and a very low-power approach to controlling current in electronic circuits. The use of PWM also yields a wide range of apparent and continuous brightness levels.

Another object of the present invention is to provide a flame simulation which changes with time, providing untiring series of patterns with the use of a microprocessor operating under a controlled set of parameters to control signal frequencies of the PWM modulated waveforms. The microprocessor control may provide, among other effects, low-frequency intervals of flame-pattern randomness to keep the simulation constantly changing, which low frequency randomness is not known to have been achieved with analog electronic circuits.

It is a further object of the present invention to provide a manufacturable light bulb replacement intended to be screwed into a lighting fixture for a pleasing simulated candle flame effect.

It is a further object of the present invention to utilize a commercially available AC power adaptor, such as those AC power adaptors commonly available for calculators or battery chargers, to provide a source of DC power to a simulated-flame votive candle.

It is a further object of the present invention to combine a simulated-flame votive candle with an urn to derive a lighted storage for cremains.

It is a further object of the present invention to provide a simulated-flame candle fixture for either an indoor or outdoor columbarium, which simulated-flame candle fixture may be prewired during construction of a columbarium to have electrical power available at a niche for an individual memorial.

It is a further object of the present invention to provide a solar-powered simulated-flame memorial with full power management to keep the "eternal flame" going as long as possible, even during periods of cloud cover during which periods the flame-pattern memorial may not recharge its batteries, providing in effect an eternal solar-powered flame simulation around the clock.

It is a further object of the present invention to provide a solar-powered in-ground memorial constructed so as to be buried in ground with its top visible surface flush with the grass, which solar-powered in-ground memorial is intended for cemeteries where monuments are placed in-ground so as to have the exposed surface flush with the surrounding grass. This memorial can be for conventional burial or an outdoor memorial for cremains.

It is a further object of the present invention to provide a combined solar-powered memorial with a grave marker by embedding a solar-powered candle into a granite or bronze marker for use in a cemetery.

It is a further object of the present invention to provide a flame-pattern simulation device for relaxation, which flame pattern a user may control by using a simple user interface.

It is a further object of the present invention to provide a lighting apparatus which includes, in a single unit, multiple lighting elements which are arranged and independently modulated in intensity to simulate a gas turbulence in a flame. Different parts of the flame may be varied at different frequencies, yet the whole flame pattern may have an overall controlled pattern, simulating both a gas turbulence and a random disturbance of a steady flame. Multiple light sources may provide the effect of flame motion as the centroid of a flame constantly moves. This is yet another dimension where the present invention differs from the prior art.

It is another object of the invention to provide a low power, yet high brightness, candle simulation with a continuous candle-simulation operating life of 20 years or more, not taking into account the battery life for battery-powered units.

It is another object of the invention to produce a flame simulation of high brightness with low power consumption.

It is another object of the invention to provide a flame-simulation lighting apparatus with digitally controlled electronic circuitry having a stored program to drive multiple lighting elements.

It is another object of the present invention to provide a relaxation lighting apparatus which produces a gentle rhythmic pattern that changes continuously with time, not relying on any apparently repetitive pattern, thereby engendering soothing visual effects to a viewer.

Another object of the present invention is to provide a flame-simulation lighting apparatus with power management and rechargeable power.

These and other features, objects, and advantages of the present invention are described or implicit in the following detailed description of various preferred embodiments.

BRIEF DESCRIPTIONS OF THE DRAWINGS

DETAILED DESCRIPTION OF THE INVENTION

BEST MODE DESCRIPTION

A microprocessor-based simulated electronic flame in its best mode uses multiple LEDs as controlled lighting elements to give the appearance of flame motion, typically when viewed through a diffuser. The plurality of controlled lights allow the simulated flame motion. Additionally, the use of a plurality of colors also enhances the effect of flame motion.

The turning on and turn off of the LEDs, caused by a pulse width modulation of an LED current, tends to broaden the spectrum of the LEDs. This leads to an increased apparent brightness of the flame. Super Brite™ light emitting diodes (Super Brite™ LEDs), which may be supplied by high-power AlInGaP amber and reddish-range LED lamps, have a wider spectrum than other LEDs. Super Brite™ LEDs may also enhance the flame motion due to color changes.

LED control may be accomplished with a current switching means being connected in an electrical path between each lighting element and an AC or DC voltage source. The current to the individual lighting element is modulated by a control circuit means. The control circuit means is driven by a digital control circuit with a stored program. The stored program provides a structured flame simulation with a constantly changing appearance.

The controlling program comprises stored instructions for generating the amplitude modulated time waveforms for controlling the current to the lighting elements. Pulse width modulation (PWM) may be performed in either hardware or program code, provided that sufficient microprocessor "bandwidth" may be available to perform the program-code operations. Drivers provide the necessary drive current for the respective lighting element. Drivers used with high-voltage AC incandescent bulbs are distinguished from other drivers.

A microprocessor-based simulated electronic-flame apparatus may incorporate certain program-coded power management features and a rechargeable power source. A control program for power management has power management features for controlling the mean, and or peak intensity of the simulated flame or individual lighting elements based on a computation of the energy stored in the power supply when used with an interruptible power source. This is accomplished by sensing when the power source is being recharged by an external power source and computing the stored power available. The available charge is computed by measuring the charge time. The discharge time is measured over a prior discharge period and validated for the a number of discharge periods which are checked to make sure that days are being measured, and that it is not clouds or shadows that are being observed. The brightness of the flame is controlled based on the estimate of the reserve charge remaining with the ultimate goal of running the flame continuously night and day resulting in an "eternal flame".

Figure 2:
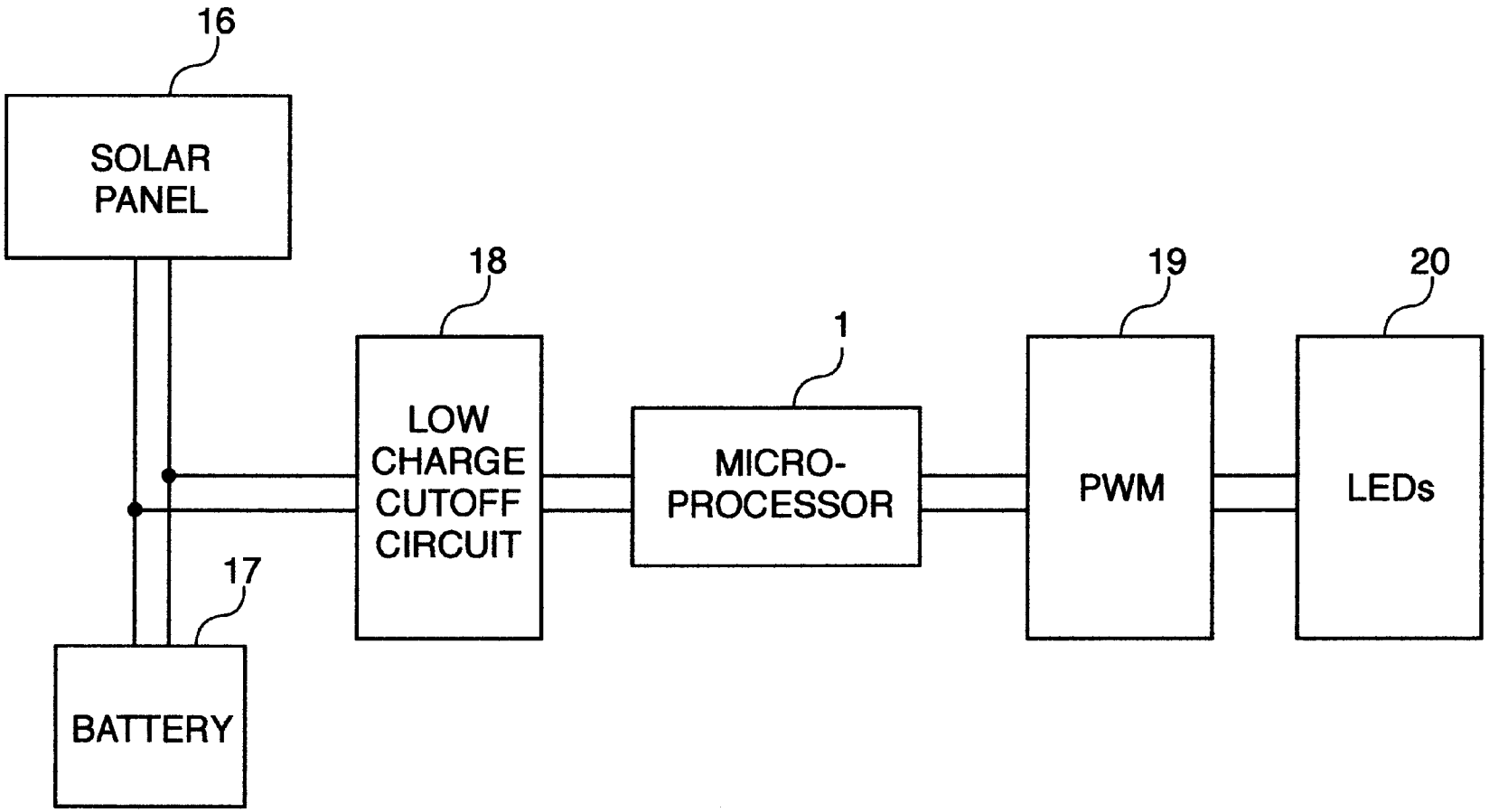
FIG. 2 is a function block diagram of a solar-powered flame-simulation circuitry.

As shown in FIG. 2, a combination of flame-simulation circuitry and program-coded power management may incorporate photovoltaic panels 16, charging circuits 18, and rechargeable batteries 17. Microprocessor 1 may control pulse width modulator 19 which in turn drives LEDs 20 to create a realistic simulated flame. This results in a simulated flame for use, for example, in cemeteries as a memorial marker. With sufficient power generating capacity the flame may run day and night, creating in effect an "eternal flame".

Additional functional features are contemplated for a microprocessor-based simulated electronic flame used outdoors in a memorial application. For example, changes in the modulation may be achieved by changing the minimum allowed current, and or the maximum allowed current to an individual LED. For daylight operation the modulation may be increased to allow more off time to allow the LEDs to have a greater on to off contrast to enhance the visibility in bright background light. Provision may also be made for periodic replacement of batteries without removing the unit from its placement. The unit may be sealed for protection from the elements.

The microprocessor-based simulated electronic flame was initially prototyped using a simpler microprocessor and a given number of Super Brite™ LEDs. The limitations of the microprocessor used and the given number of Super Brite™ LEDs deployed were merely constraints involved in prototyping, and should not be construed to prevent larger and/or varied lighting configurations supportable with faster microprocessors.

Figure 1:
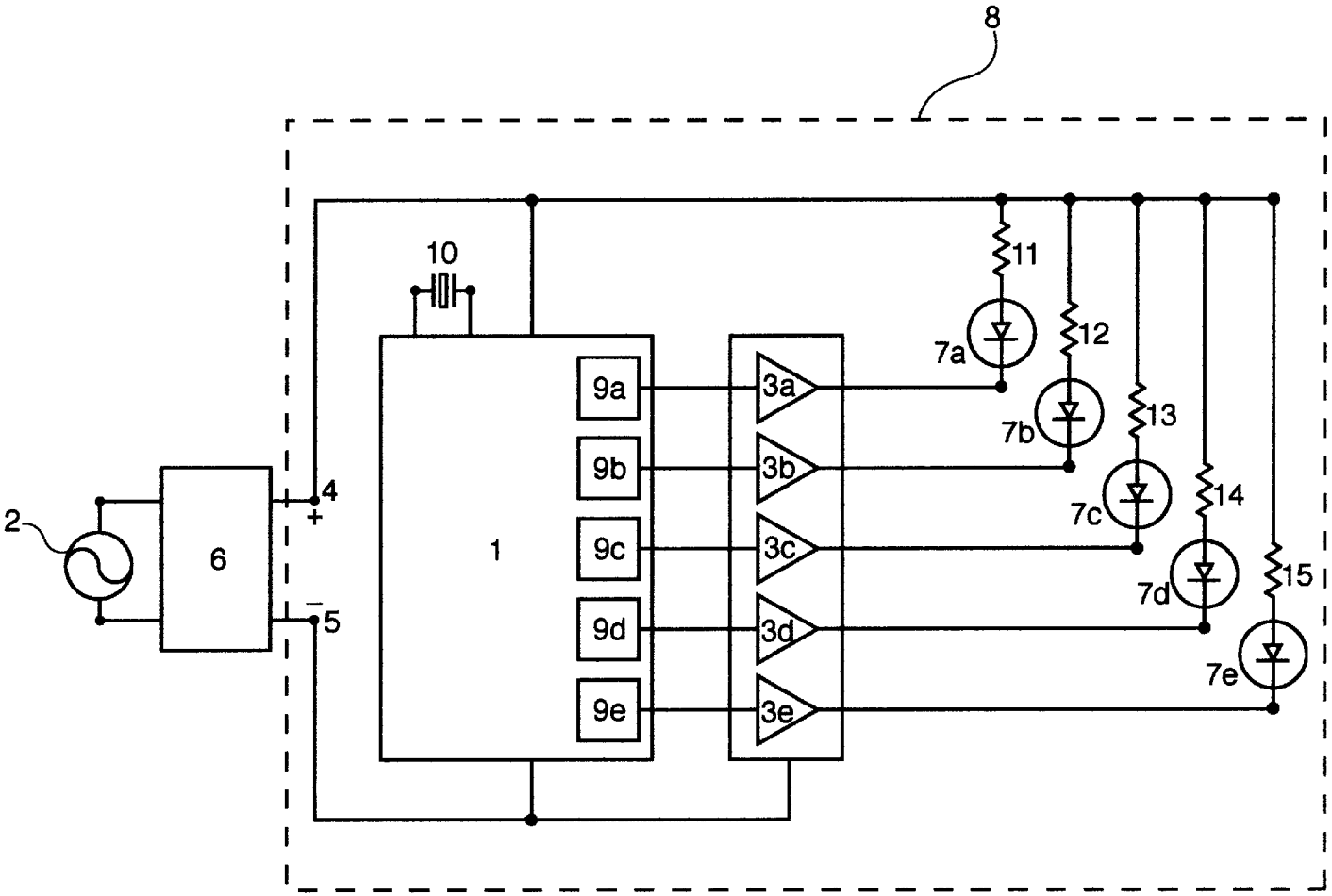
FIG. 1 is a functional block diagram of a microprocessor-based electronic circuit comprising a flame-simulation circuitry.

FIG. 1 shows a functional block diagram of a microprocessor-based prototype circuit comprising a flame-simulation circuitry. The device 8 initially consisted of a set of five Super Brite™ LEDs 7*a*, 7*b*, 7*c*, 7*d*, and 7*e* (LEDs 7*a–e*) in 2 or 3 different colors. The Super Brite™ LEDs may be supplied by High Power AlInGaP Amber and Reddish-orange Lamps from Hewlett Packard. Also known as Super Brite™, or Ultra Brite™, the LEDs are high efficiency LEDs and are known to be available in red, amber, and yellow colors. However, light-emitting diodes are generally available in a number of suitable colors from many different manufacturers.

The LEDs may be driven by drivers 3*a*, 3*b*, 3*c*, 3*d*, and 3*e*, each of which boost the current drive capability of the respective one of five PWM modulator outputs 9*a*, 9*b*, 9*c*, 9*d*, and 9*e* of the microprocessor. Each of resistors 11, 12, 13, 14, and 15 are coupled with the respective one of LEDs 7*a–e*, which resistors limit the currents through LEDs 7*a–e*.

Input power terminals 4 and 5 require a DC voltage of about five volts. With a different choice of microprocessor the unit may operate over a wide range of DC voltages. The DC power supply G is shown in FIG. 1 as being powered by an AC power source 2.

Microprocessor 1 was initially supplied by a Motorola MC68HC05D9, which is a very low power CMOS microprocessor. Motorola MC68HC05D9 has a sizeable memory, input/output, and computing functions on a single silicon chip. The frequency reference for microprocessor 1 may be supplied by a standard quartz crystal 10. However, for cost savings a ceramic resonator may be used for less expensive models. For this microprocessor application the absolute frequency tolerance of a more expensive crystal was not required.

Microprocessor 1 runs a timer-controlled and interrupt-driven time loop to calculate the current values for each LED, and loads the current values into PWM registers 9*a*, 9*b*, 9*c*, 9*d*, and 9*e*, which registers are located on the microprocessor chip.

Figure 12:
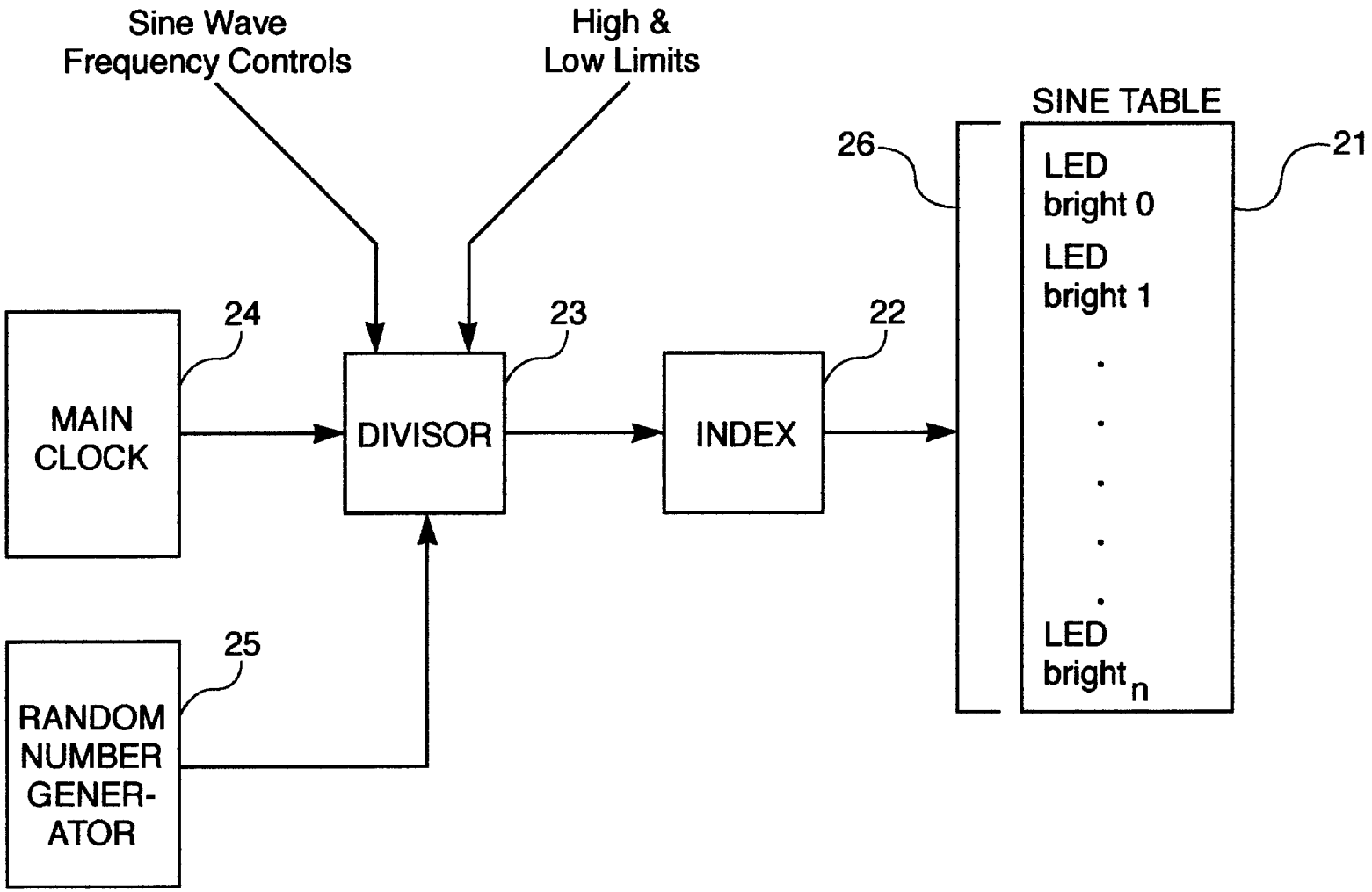
FIG. 12 is a process block diagram detailing the indexing of a flame-simulation sinusoid table.

Sinusoidal wave values were initially used as fundamental excitation values for each of LEDs 7*a–e*. As shown in FIG. 12, the program code may use a table 21 of stored sine wave values, which table 21 is indexed (see index 22) at varying rates to generate differing period waveforms for each of LEDs 7*a–e*. For each of LEDs 7*a–e* a circular buffer pointer 26 may be used to access the sine table 21. Additionally the data structure for each of LEDs 7*a–e* may have a pointer to the start of the current waveform table and the end of the table so that the circular buffer pointer 26 may wrap to the beginning of the stored waveform when it gets to the end.

The fundamental waveform may be stored as a single period of a sine wave. The sine wave resolution of eight bits was initially used. Waveforms may also be stored for other signal shapes to provide envelopes for disturbances such as wind or flame instability. These alternative waveforms may be used to control the overall brightness of LEDs 7*a–e* together.

Figure 11:
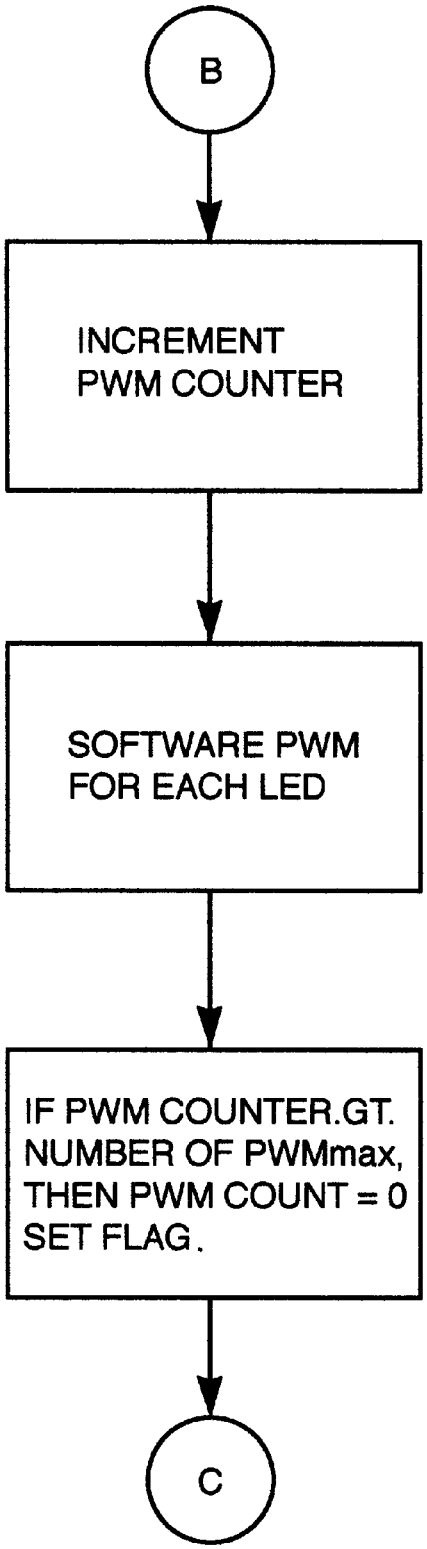
FIG. 11 is a functional block diagram showing the interrupt-handling process of the flame-simulation program.

In the steady state each of LEDs 7*a–e* is PWM modulated by the hardware to achieve a selected brightness. As shown in FIG. 11, at each timer interrupt the interrupt handler code loads the PWM register with the desired duty cycle for the LED. The code sets a flag bit to say that the timer has been serviced.

Figure 10:
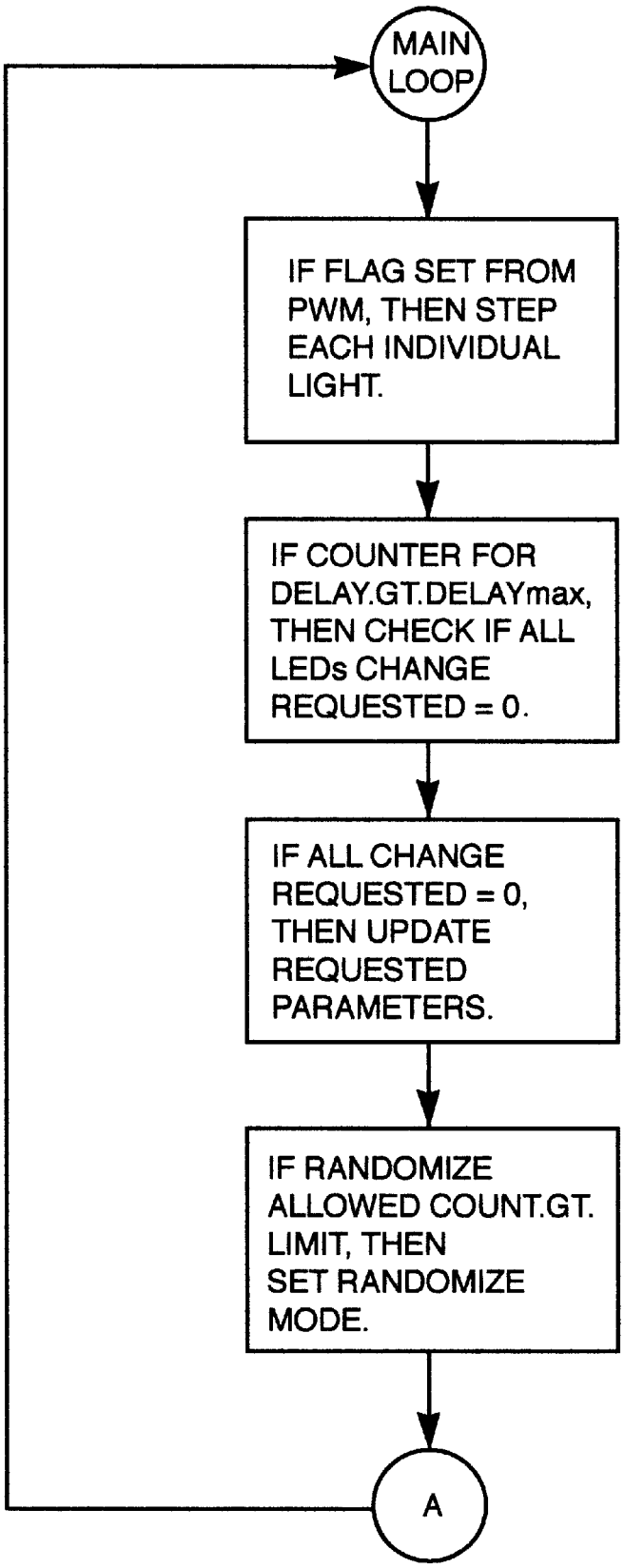
FIG. 10 is a functional block diagram showing the main loop of the flame-simulation program.

As shown in FIG. 10, the code in the main loop that cycles through the waveforms for each of LEDs 7*a–e* checks to see if a flag bit has been set. When the flag bit is found to be set the code to step through the waveforms is executed. To run the individual sinusoid at different frequencies a prescaler is used. A counter is used to count down each time the flag bit has been set by the interrupt service routine, which routine is shown in FIG. 11. When the count (driven by main clock 24) reaches zero the counter is reloaded with the frequency divisor 23 for that LED and the circular buffer pointer for the sine wave position is incremented. See FIG. 12 for the circular buffer pointer 22. If the pointer is past the end of the buffer it is reset to the beginning. The pointer is used to index (see index 22) into the stored sinusoid and get the current value for the LED. This is put into the present intensity variable for the particular LED.

A simulation with each of LEDs 7*a–e* repetitively going through a single sequence may be boring. Therefore, certain changes in the selected sinusoid pattern and frequency that lend interest to the simulation were incorporated. A signaling mechanism (random number generator 25) was constructed to change the value of the prescaler divisor, and hence the observed frequency of the resultant sinusoid.

For each of LEDs 7*a–e* there is a flag bit to indicate that a change in the divisor is requested. When the flag is set the code attempts as described below to change the value of the divisor. Additionally, depending on the mode described later, all or almost all of LEDs 7*a–e* must have reached the requested new frequency as signaled by the resetting of the change requested flags. Some modes require all of LEDs 7*a–e* to have reached the requested frequency before a change can take place. Other modes allow one or more of LEDs 7*a–e* to be in the process of attaining the requested frequency when new requested frequencies are selected for all LEDs 7*a–e*.

A significant advantage of the invention is the smooth change in the frequency of modulation of a single LED with time. Like a real flame the change in frequency is continuous and not abrupt. The modulation of a LED is accomplished by indexing through a stored sine wave table with a pointer as described above. At the end of a full cycle of the stored waveform the change requested flag is checked to see if a change is pending. If so the divisor for the counter for stepping through the waveform is incremented or decremented as required. The pointer is updated. This has the net effect of having the slowly modulated LEDs change smoothly in frequency over time. Since the LEDs which are being modulated faster, cycle through the stored single cycle of the waveform faster, they change quickly from one frequency to the requested frequency. Once the desired frequency is attained, the change requested flag for that LED is reset.

Another "higher level" routine counts a prescribed number of cycles and when the count is reached, it attempts to alter the frequency of all of the sinusoids. As an illustration, the mode may be one of: still, wind, slow_bright, slow_dim, fast, and soft. Depending on the mode that is set a different set of parameters for the individual LEDs will be set. Within the confines of the selected set of parameters the frequencies of the sinusoid will be pseudo-randomly selected. But this routine is only allowed to run if all of the aforementioned request flags have been reset when in slow mode.

Different effects were achieved by controlling the modulations of LEDs 7*a–e*. Controlling the frequency of the sinusoid and the changes from one frequency to another lead to many different types of flames. When the requested changes to the frequency are limited to a single count up or down only, for instance the flame is a very slow rolling flame that is similar to a votive candle in a deep glass. The mode that was selected the majority of the time is a slowly varying simulation that changes every few cycles but only a limited amount.

When the requested frequency changes were random and large the flame acted like a candle in the wind. A variety of different modes for the flame simulation were available using this invention. Additionally, the sequence of the modes were optionally in a list that is sequenced through pseudo randomly or sequentially. The program alternates between simulating a pleasingly stable flame and a flame with occasional wind disturbances as found in the randomness of a candlelight.

Another routine has the function of stepping through a table of the available modes pseudo-randomly with some limits for how often the flame can go "unstable" and injecting some of the different disturbances on a very limited basis. Tuning this routine is what gives the simulation the ability to be used in a wide range of applications, each application being tuned to the needs of it's particular audience.

As shown in FIG. 12, the prototyped flame simulation is table driven. Each LED has a code structure associated with it that contains all the data for the specific state of the LED and the simulation. Limits for how fast or how slow the sinusoid should be allowed to go for a LED are in the table. The maximum allowed brightness and minimum allowed brightness for the individual LED are also in the table for a particular state.

The start-up code specifically starts the simulation in a known state so that the phases of the individual sinusoids are different to prevent the LEDs from all starting out in phase. Yet, there is a randomization performed to prevent a group of coupled units from starting up with identical patterns.

The overall brightness of a flame and a superimposed overall amplitude modulation may be achieved by adding or subtracting a waveform or DC constant from all or some of the LEDs. Multiplication of the signals is contemplated when a faster microprocessor or a microprocessor with a hardware multiply is used.

Pseudo-random number generating techniques are a well known art. Pseudo-random number generation is incorporated in this specification by reference. See, random number generator 25.

To achieve a simulated flame effect the individual LED light emissions need to be diffused with a glass or plastic diffuser. Inner surface of a glass decorative element may be sandblasted or etched to serve as the diffuser. A decorative element may be as simple as a frosted votive candle glass in the simplest embodiment. For other embodiments the diffuser can be some arrangement of cut crystal or ornamental diffuser element.

The preferred embodiment has a diffuser with a frosted base to blend the different colors of light together and also provide a screen on which the movement of the flame is visible. Depending on personal choice the upper portion of the diffuser can be frosted or clear. Diffusers will come in many shapes and sizes as required for each particular application. For a more pleasing appearance two layers of diffusers may be used in some units. The inner diffuser could be flame shaped to combine the light from the individual LEDs into more of a point source. The outer diffuser may be more of a light screen for the flame to be visible against.

DESCRIPTION OF ALTERNATIVE PROTOTYPE IMPROVEMENTS

Another way of modulating the LED current is with the microprocessor performing the PWM function in code rather than in the hardware. A sufficiently fast processor with the clock speeds ranging 12–24 MHz or better may be required. Suitable processors based on the Intel or Philips 8051-based family of processors may have the desired processing speeds. 8052 processors, on the other hand, may be preferred, because 8052 processors have larger memory capabilities than 8051 processors.

Pulse width modulation (PWM) is a known function which those skilled in the art can implement in either hardware or code. In FIG. 1 the hardware PWM modulators 9*a*–9*e* may be eliminated and replaced by code. The PWM function may be moved to the interrupt service routine and the timer interrupt rate may be adjusted accordingly. Shown in Appendix A is an updated source code listing of a "C" code executable in a 8051-compatible processor environment to effect the flame simulation capabilities with PWM demonstratively implemented in code.

If the PWM function is performed in code, then the overall intensity of the flame may be controlled by inserting extra off cycles into the PWM loop. This is accomplished by inserting some off states into the waveform on a periodic basis. For the LEDs this has the effect of increasing the dynamic range of the PWM control. The simulation may be quite dim and still be effective. This is due to the fact that the eye operates logarithmically. Additionally it is the peak intensity that provides the visibility. Using these principles the number of dark periods in the waveform may be increased greatly, provided that the initial PWM frequency is high, to the point where the simulation is quite dim before the flame simulation begins to flicker and the effect is lost.

The code is not limited by the bits of resolution that are available in a hardware solution.

Another variation using PWM in code uses a microprocessor such as a Digital Signal Processor (DSP). This variation allows the waveforms to be generated on the fly rather than being stored in tables to conserve memory space. The equations for the simulation may be directly implemented on the DSP with all of the waveforms generated and control feedback control loops used to implement the simulation. Once the control equations were written the code may be implemented by those skilled in the art of programming DSPs.

Figure 3:
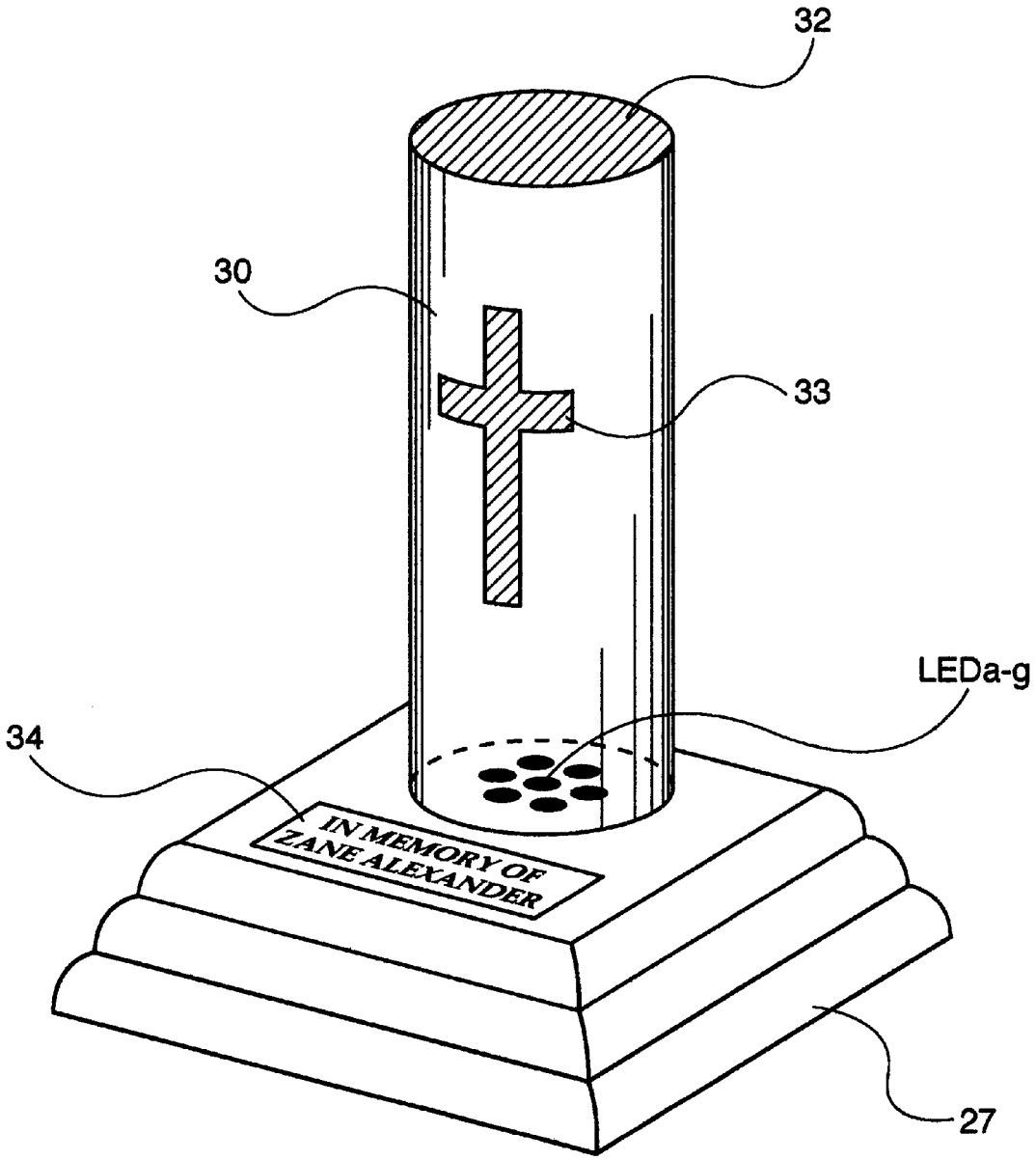
FIG. 3 is a front perspective view of a flame-simulation memorial candle.
Figure 4:
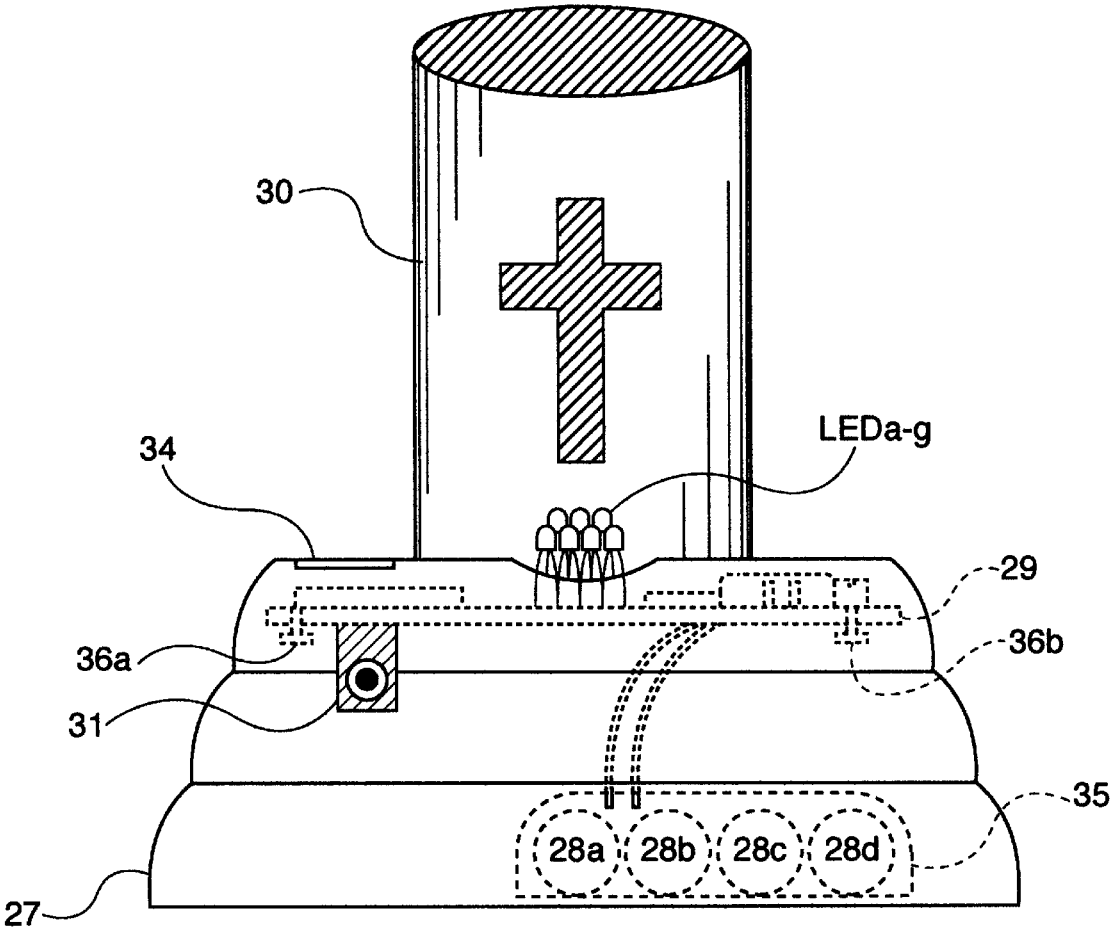
FIG. 4 is a front perspective view of a flame-simulation memorial candle with internal flame-simulation circuitry exposed to show the locations of circuitry placement.

The system was initially prototyped with five LEDs, because the selected microprocessor had five PWM controllers. However, designs with as few as two LEDs, and possibly ranging up to a dozen or more LEDs, are contemplated. For example, FIGS. 3 and 4 is shown with seven LEDs. Not all such LEDs require control. For example, six of possible seven LEDs may be microprocessor controlled, while the seventh LED may be steady on or off.

As another improvement electric light bulbs may be substituted for the LEDs if a white light is desired. The light bulbs may be driven with suitable higher current drivers. This may be accomplished with either low voltage light bulbs or if desired 110 volt bulbs may be used with triacs used as the drivers. A minimal implementation may use a single filament light bulb with the multiple frequencies summed together in the code and a single triac controlling the current through the light bulb. To use a triac to control the current through a light bulb the conduction angle is controlled by where the triac is "fired" with respect to the 60 Hz line frequency. This is the principle on which all modern incandescent light dimmers operate and is well known by those skilled in the art.

As another improvement an application specific integrated circuit (ASIC) with the aforementioned algorithms may be implemented with a greater portion of the function in hardware, using ROM for the waveforms and shift registers for the pseudo-random number generation with hardware PWM circuits. This would in effect be a microprocessor or micro-sequencer dedicated to the flame simulation function. This could quite easily be implemented by those skilled in the art of digital circuit design. An additional feature of a custom chip would be the ability to operate with higher voltages and have the drive capability for a series parallel arrangement of LEDs for a higher light output.

One final considered feature is the addition of shielding for electromagnetic interference. An integral part of the device is the requirement for shielding to avoid interference due to the mega-hertz frequencies involved. Shielding may be provided by the base unit or additional shielding can be added as required.

FLAME-SIMULATION MEMORIAL CANDLE EMBODIMENT

A simulated candle embodiment is shown in FIG. 3. This is a stand-alone simulated candle $LED_{a-g}$ built to look like a votive candle standing on a base 27. $LED_{a-g}$, when activated, serve as a simulated flame sitting inside a porcelain-quality decorative figure, which porcelain-quality decorative figure serves as a light diffuser 30 covering the LEDs ($LED_{a-g}$). There may be provided a recessed area 34 on the base 27 containing a nameplate for customized engraving.

The diffuser 30 as shown in FIG. 3 may be a porcelain, glass, or plastic figurine utilized as a decorative element to diffuse simulated flame LEDs ($LED_{a-g}$) within it. The diffuser 30 is made to look like a glass holder for a votive candle and can be made in any size, shape, and style. The inner surface of a hollow diffuser 30 may be sandblasted to act as a light diffuser. The top 32 of the hollow diffuser 30 may be sealed. A symbolic design 33 may be sandblasted into inner or outer surface of the hollow diffuser 30. Additionally, the top 32 and or sides of the hollow diffuser 30 may have a name and/or remembrance etched or sandblasted on it.

As shown in FIG. 4, a simulated candle embodiment stands on a base 27 which may be hollow to house all of the electronics and batteries. The base 27 may also provide shielding for electromagnetic interferences. All of the electronic components may be contained on the circuit board 29 which may be secured to inside of the base 27 by means of a plurality of screws 36*a*–*b*. A plurality of rechargeable batteries 28*a*–*d*, for example, AA rechargeable batteries, may be housed in a battery holder 35 and connected through a switch to the circuit card 29, all of which may be located inside the hollow base 27. The rechargeable battery pack 35 provides backup power during AC power outages.

An external AC power adapter with a plug may connect to a socket 31 to provide external power. An AC adapter is commonly found in todays consumer products, and may comprise a step down transformer and a rectifier to provide DC power to the unit.

URN WITH A BUILT-IN SIMULATED-CANDLE EMBODIMENT

Figure 6:
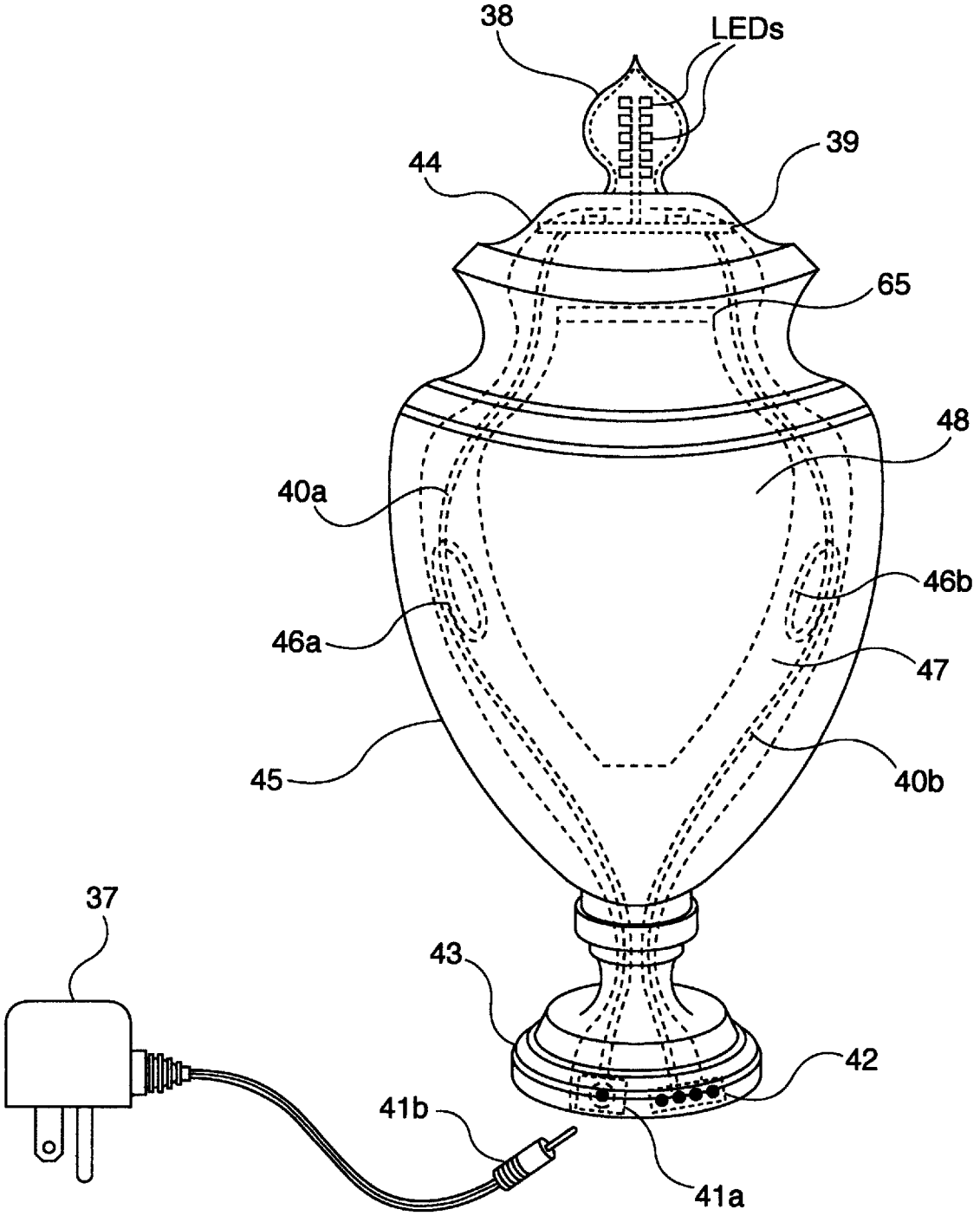
FIG. 6 is a front perspective view of an urn showing a built-in flame-simulation candle and the internal flame-simulation circuitry exposed to show the locations of circuitry placement.

Another embodiment incorporating a simulated candle is shown in FIG. 6. A stand-alone simulated candle is built into an urn 45 for cremains. The urn 45 has an inner cremains container 48 and a hollow core 47 inside its outer body, and has a supporting base 43. On top of the urn 45 is an urn top 44. Where the urn 45 mates with the urn top 44, the cremains container 48 is sealable with a cremains safety seal 65. The urn top 44 has a visible diffuser 38 which covers LEDs within. The diffuser 38 is shaped to look like a glass holder for a votive candle and can be made in any shape and style.

An urn with a built-in simulated candle is powered by an external commercially available power supply 37 commonly found in todays consumer products. The power supply 37 may comprise a transformer and an AC to DC power supply. The power plug 41*b* of the power supply 37 may mate with a power socket 41*a* on the base 43 of the urn 45 to provide the external AC power. A rechargeable battery pack 42, which provides backup power during AC power outages, may be hidden in the hollow base 43. The power plug 41*b* of power supply 37, upon mating with a power socket 41*a*, charges a rechargeable battery pack 42.

All of the electronic components may be contained on a circuit board 39. The wires 40*a–b* to the circuit board 39 are long enough to allow the top 44 to lie on the same plane as the unit stands on when the top 44 is removed. When the top 44 is closed, service loops 46*a–b* of wires 40*a–b* may be formed inside a hollow core 47 through which wires 40*a–b* traverse.

Many different styles of urn 45 may be combined with a simulated flame or candle. The "candle" LEDs may be placed on top as illustrated in FIG. 6 or inset into the side of the urn. The simulated candle may also be built into the bottom of the urn. The urn 45 may be made of bronze, porcelain, wood, marble, or any material commonly used for urns.

An urn 45 with a simulated candle may use any of the other simulated electronic or electrical candles or lamps mentioned in the prior art in combination with an urn for cremains. An urn 45 with a simulated candle may comprise the combination of an urn for cremains with one or more of the several alternative electrical or electronic lights.

MAUSOLEUM AND COLUMBARIUM ETERNAL-LIGHT EMBODIMENT

Figure 8:
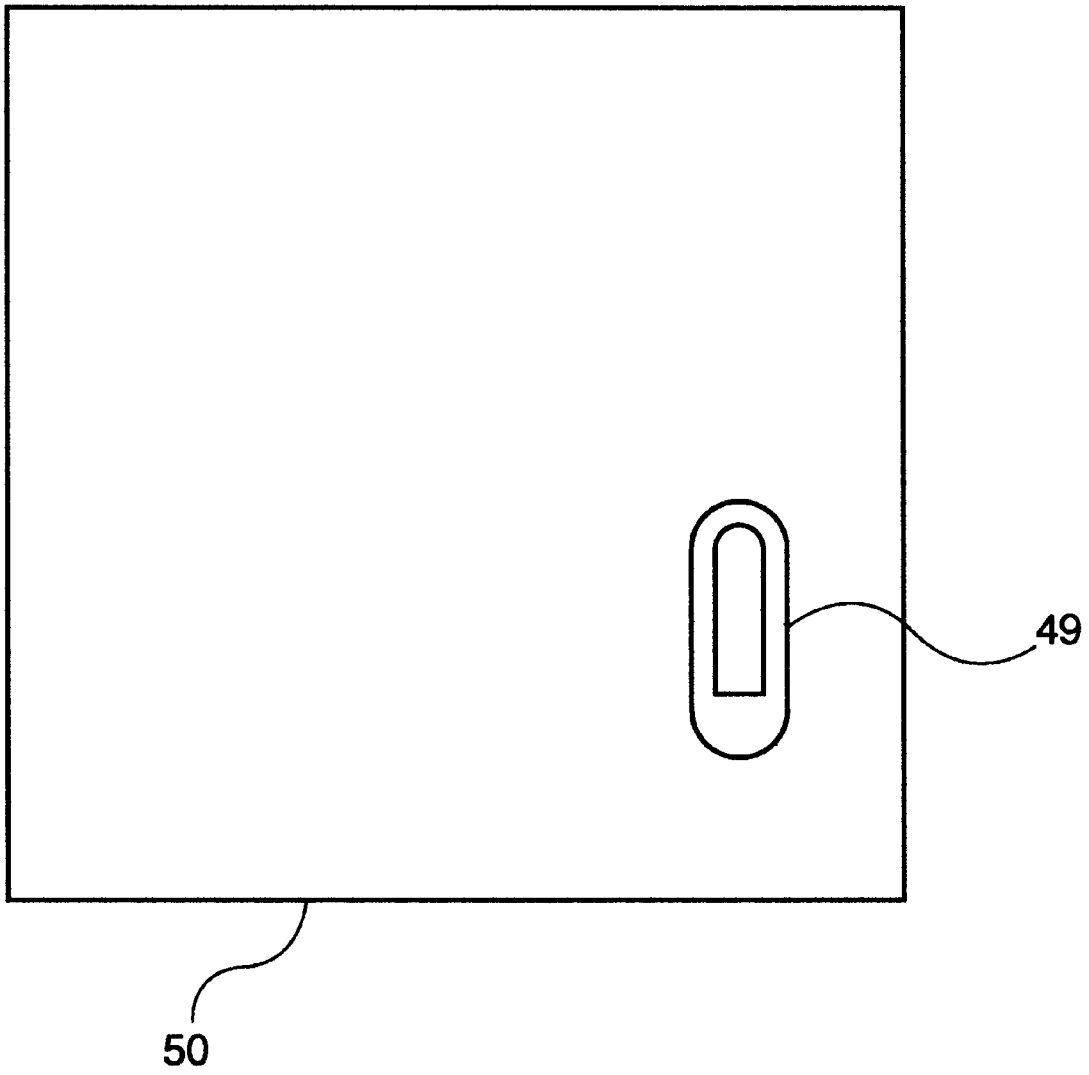
FIG. 8 is a front view of a crypt front or urn niche of a columbarium with a built-in mausoleum eternal light.

Another embodiment incorporating a simulated candle is shown in FIG. 8. A mausoleum or columbarium eternal-light fixture 49 may be used for both outdoor and indoor crypt or niche applications. Columbariums are constructed by companies that specialize in the business and they are generally built with precast units assembled together on site. It is a simple matter to provide electrical power for every crypt or niche 50 while the modular unit is being cast by embedding wires running to every crypt or niche in the unit. During construction the mausoleum or columbarium is pre-wired with low voltage AC power at every crypt or niche 50 provided by a central step down transformer or a plurality of transformers. The individual eternal light 49 then only require a simple AC to DC power supply consisting of a design as simple as a rectifier and a capacitor. A voltage regulation circuit would be optional depending on the microprocessor selected. As the individual crypts or niches are filled the eternal lights are added on the front panels. Such an eternal light is shown in FIG. 9.

For an open-face style niche 50 with a glass front an eternal light 49 is added to the contents of the niche. The glass front niche is also another place where the urn with the built-in light can be displayed. This application may use one of the existing embodiments described above if the niches are pre-wired with 110 volts AC, or it may use the aforementioned embodiment which is designed to operate using low-voltage AC power.

Figure 9:
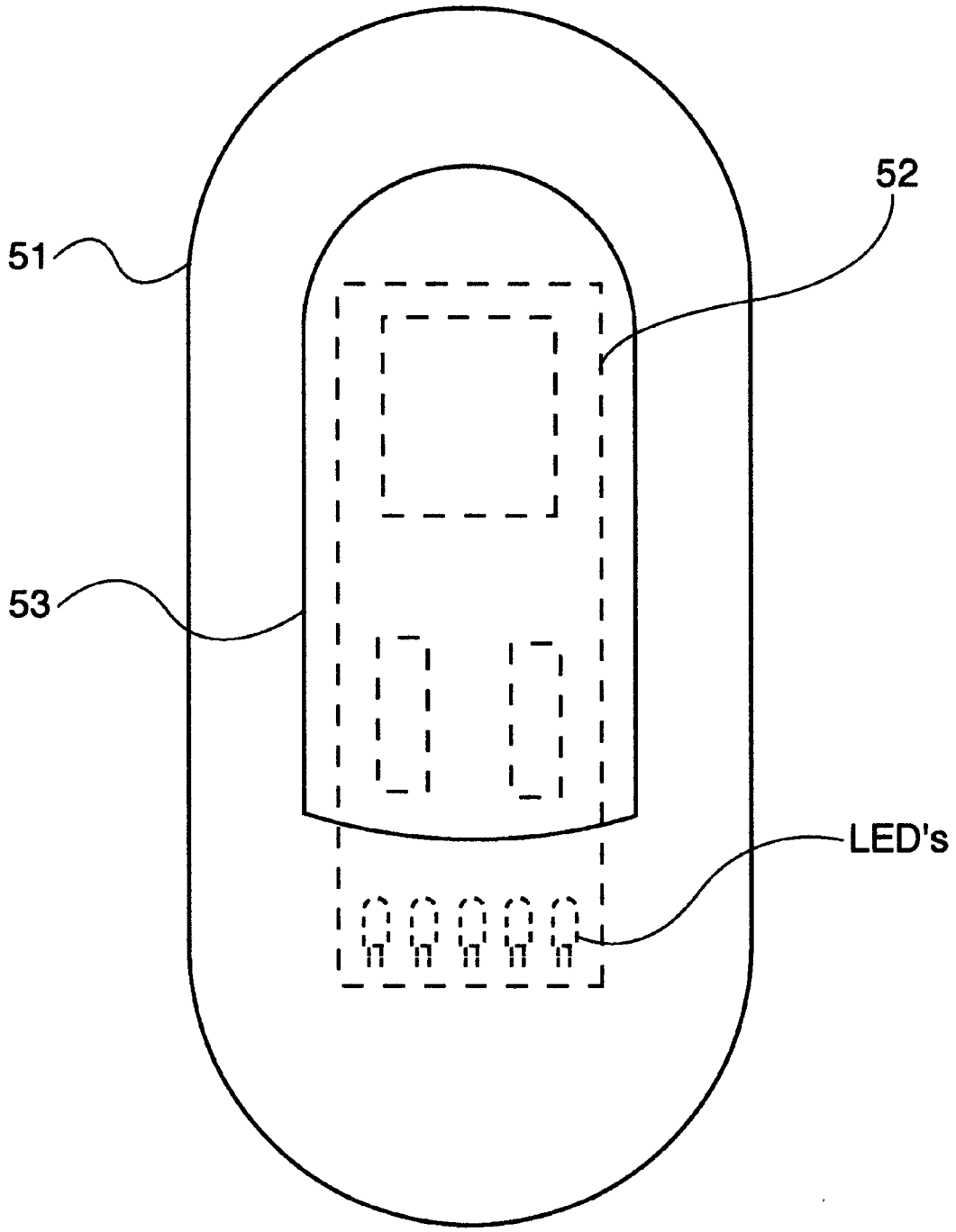
FIG. 9 is a front view of a mausoleum eternal light with its internal flame-simulation circuitry exposed to show the locations of circuitry placement.

As shown in FIG. 9, an eternal light may consist of a metal housing 51 with a circuit board 52 hidden behind a diffuser. Simulated-flame illumination is provided by emanations from a set of LEDs and diffused through the diffuser 53.

SOLAR-POWERED ETERNAL-FLAME MEMORIAL

Figure 7:
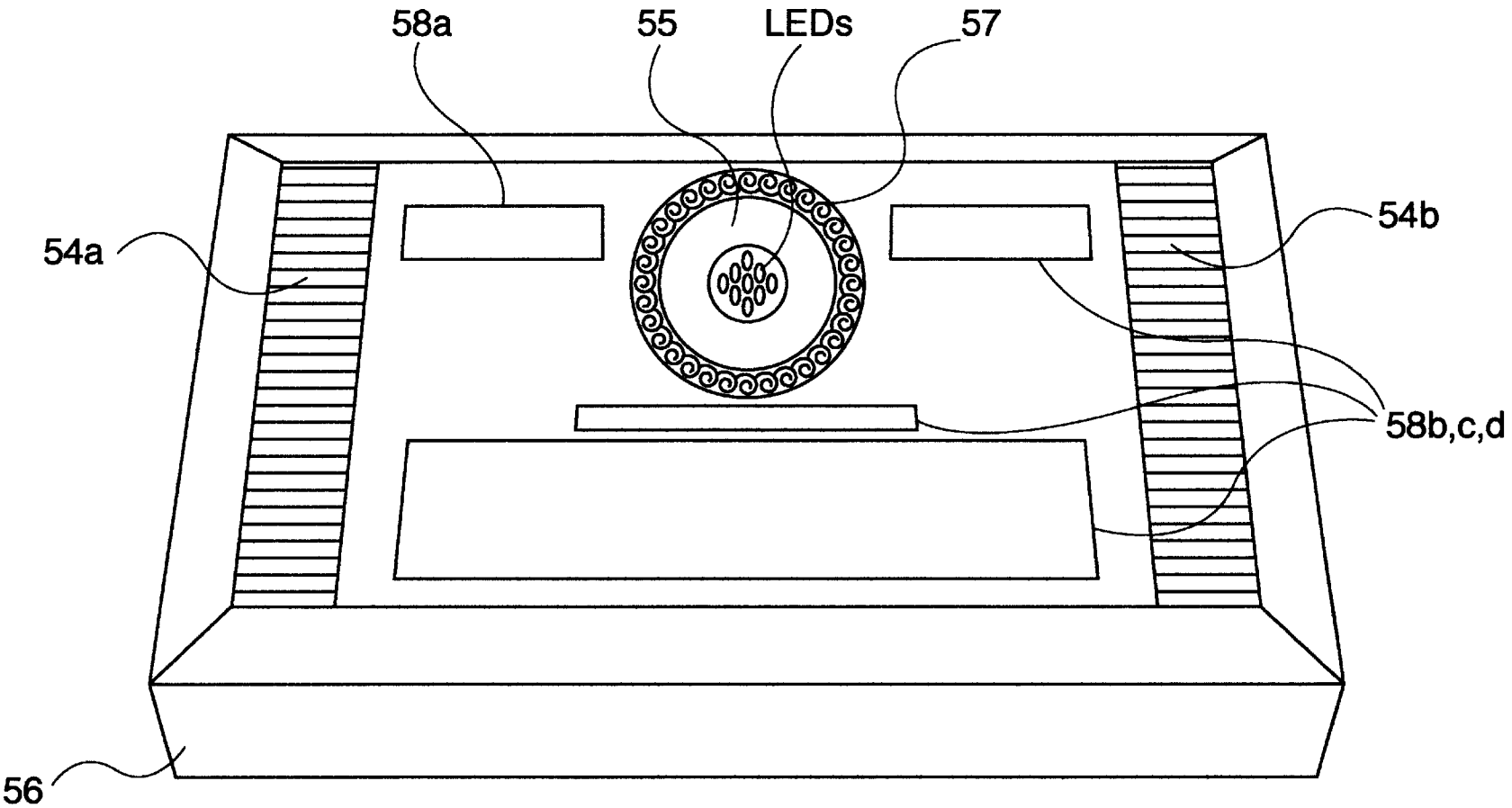
FIG. 7 is a front perspective view of a solar-powered eternal-flame memorial combined with a grave marker.

Another specific embodiment is the combination of an in-ground memorial with a solar-powered memorial. An in-ground memorial is commonly found placed in-ground at a cemetery with its memorial face visible and even with the ground. Preferably built of bronze or granite, the memorial 56 may have solar panels 54*a–b* exposed with an eternal-flame combination of LEDs and diffuser 55 built into the monument 56. The electronics and batteries are hidden in the unit. A bronze ring 57 is provided for replacing or removal of rechargeable batteries from the top on a periodic basis. FIG. 7 is a drawing of a solar powered "eternal flame" combined with a flush memorial.

There are a number of memorial variations that result from the combination of the solar powered "eternal flame" with a memorial. The contemplated memorial light variations include: in ground, above ground, and combined with a gravestone or memorial for burial or memorialization of cremation. Such a memorial may incorporate nameplates 58*a–d* and may be used as a marker or a gravestone.

FIG. 2 shows a functional block diagram of a solar-powered flame-simulation circuitry for a memorial application. A solar energizing means 16 is connected to a battery 17 through a normally forward biased Schottky Diode in operation when the voltage across the terminals of the solar cell is greater than the voltage across the battery. Systems which use batteries that require protection from damage due to low voltage, such as lead acid types, require the optional low voltage detection unit. The low voltage detection unit has hysteresis to prevent the device from operating until the battery has sufficient charge. Low voltage detectors are available commercially.

A comparator is used to sense when the battery is being charged by sensing the difference between the voltage on the solar cell side and the battery side of the diode. The microprocessor 1 has the capacity to sense when the batteries 17 are being charged by monitoring the logic level produced by the comparator at an input pin of the microprocessor. By timing the duration of the charge, with an intelligent sensing of clouds and shadows, the stored power can be determined. This gives an estimate of the allowed power budget. During periods of charging if the calculations indicate that the battery is charged up the control program will increase the mean and or peak intensity of the simulated flame to make it more visible in daylight.

The discharge period from the previous day is also measured. This then gives an estimate of the required power for the following night. Reserve capacity for multiple nights is required to deal with cloudy or rainy days. As a normal operating policy the brightness is reduced after what is calculated to be 1 AM or some other selected time to reduce the overall power requirement. As the reserve capacity is calculated to be getting low the overall intensity of the flame is further reduced on a nightly basis for the second half of the night, or other predetermined period, when the expected background illumination is expected to be reduced and less power is required.

An additional feature of the solar-powered program is that the code can determine that the unit is in continuous charge if it is connected to an AC adapter. Once the unit has determined that the charge is continuous the operating mode is changed and it can go to full brightness or an inside program as opposed to an outside program. The interrupt service routine runs a real time clock. The concept of a real time clock is well known to those skilled in programming. By using the real time clock to measure a charge time in excess of a predetermined period the code can tell that the charge is continuous.

A coil, which forms half of a toroidal transformer, may be provided in the bottom of the unit. It allows charging of the units before installation outside. It also allows indoor demonstration without having to put in a plug, which plug may allow moisture to get in when the unit is put outside. A rectifier and capacitor may comprise a DC power supply in addition to the solar cell. The other half of the transformer would be in a base that the unit would be set on to demonstrate or charge it. This allows the unit to be demonstrated without modifications and to be pre-charged before delivery with ease. It has the added advantage of easy unit removal and handling by the customer without the tangling of cords.

SELF-CONTAINED FLAME-SIMULATION LIGHT BULB

Figure 5:
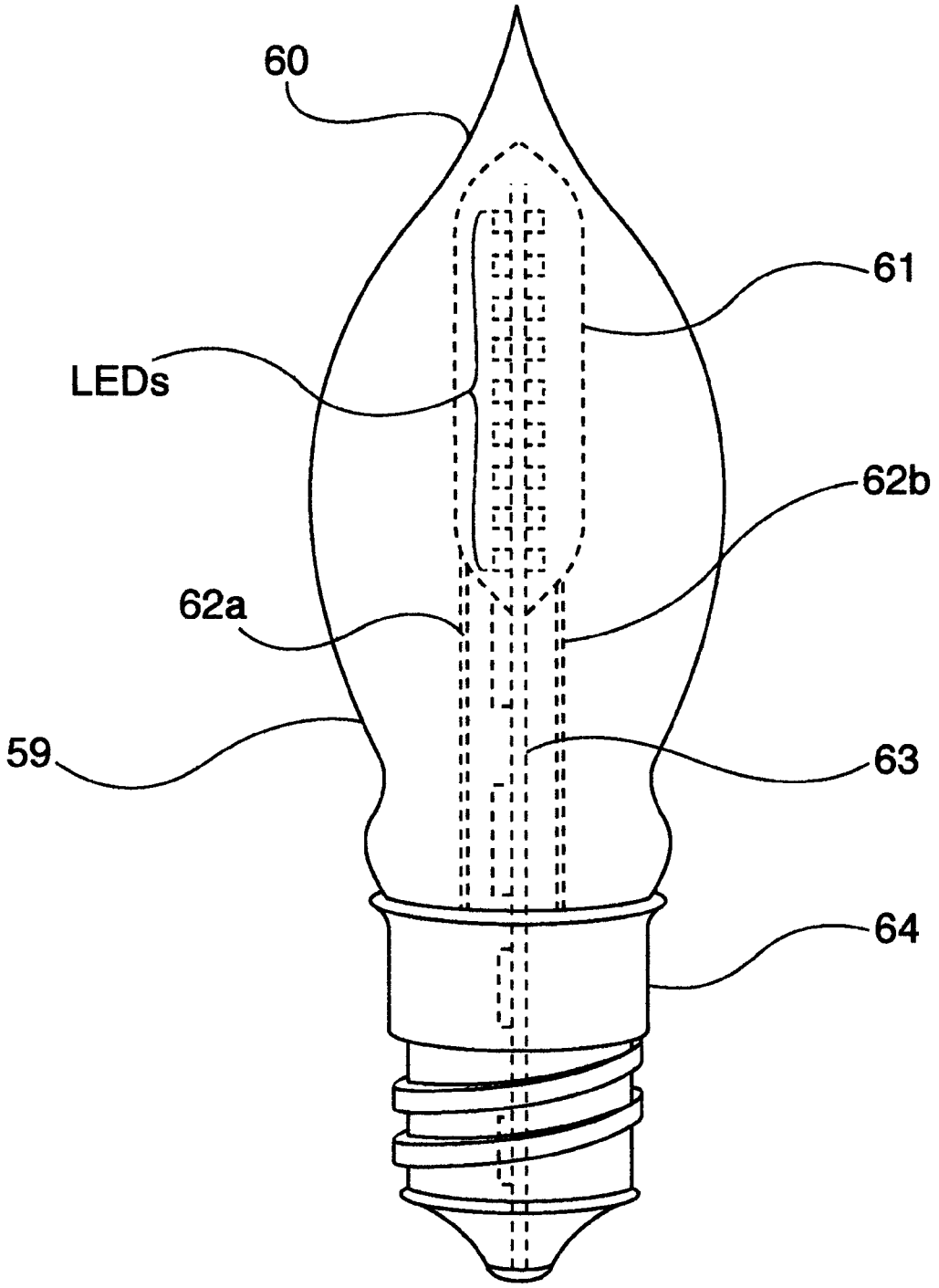
FIG. 5 is a front perspective view of a self-contained flame-simulation light bulb for AC/DC operation with its internal flame-simulation circuitry exposed to show the locations of circuitry placement.

An alternative embodiment is the self contained candle light bulb 59 for the new and replacement market for decorative and religious lights to fit in standard lighting fixtures. FIG. 5 illustrates a preferred packaging arrangement for the simulated candle when used as an individual bulb 59 for use in Edison base style lamps. The flame-simulation light bulb may comprise an envelope 60 which may have a frosted light diffusion inside, an optional inner diffuser 61, RFI shields 62*a–b,* a circuit board 63, and a standard base 64.

The LEDs are closely spaced together to provide a point source of light. By employing current manufacturing technologies such as surface mounting of components and chip on board die attach techniques, it is possible to package all the components for the bulb 59 into the envelope of the light bulb 60 along with the AC to DC power supply, making it a self contained unit capable of being used in any standard lighting fixture. The electronic components are directly attached to the circuit board 63. The envelope 60 can either be a standard glass light bulb envelope or the whole unit could be encased in plastic.

The power supply for the self contained light bulb for AC mains operation may be based on the Unitrode UCC1889 Off line power supply controller chip. The Unitrode UCC1889 Off line power supply controller chip is a commercially available component, and it is hereby incorporated by reference.

Additionally, for increased brightness the LEDs may be arranged in a series parallel arrangement to increase the light intensity. Both sides of the circuit board would have LEDs to provide a more uniform light visible in all directions. The LEDs can be chip LEDs wirebonded to the circuit board as shown in FIG. 5. Using the Unitrode chip some LEDs in series with the microprocessor could be used to drop the voltage as well as provide additional steady light for the self contained bulb where higher light output is easily attainable.

FIREPLACE LOG-SIMULATION EMBODIMENT

Another alternative embodiment is a fireplace log simulation. Multiple independent "candle" units may be grouped together in a simulated plastic or ceramic log or logs for a simulated fire in a fireplace. This embodiment may use a glass or plastic projection screen as a diffuser to blend the light.

RELAXATION LIGHTING DEVICE

A final embodiment uses the flame simulation as a relaxation device by providing a very simple keypad interface to allow the user to control some parameters of the simulation. Many consumer products provide keypad interfaces and interfacing and debouncing keys in code are known to many skilled in the art. The programmable aspects of the simulation would be the underlying high frequency 3 to 12 Hz ( Theta to Alpha) signals and the overall speed and stability of the simulation.

The present embodiment is a relaxation lighting apparatus which produces a gentle rhythmic light pattern that changes continuously with time, not relying on any apparently repetitive pattern, thereby engendering soothing visual effects to a viewer. Modern scientific research shows that rhythmic light patterns can produce a feeling of contentment and profound relaxation. By adding a faster low amplitude sub component of the flame at frequencies in the theta to alpha regions of 3 to 12 hz a deeper feeling of relaxation can be induced. With multiple LEDs is it possible to introduce the effect without an obvious blinking light appearance. The lighting elements are modulated in intensity with a microprocessor 1 providing the control for a smoothly changing pattern, without the "flicker" appearance of other simulations. The LEDs are controlled with PWM at a high frequency. The eye integrates the pulses of light into a continuously on light of varying brightness. The appearance to the eye is one of a constantly on light that is modulated in intensity with an apparent continual range of intensity modulation. The higher frequency modulation can be added without making it obvious to the viewer.

Thus, there has been described a simulated electronic flame which has a great variety of different applications.

Various modifications may be made in and to the above described embodiments without departing from the spirit and scope of this invention. For example there are many types of microprocessors which could be used to provide the data storage and generation functions of the microprocessor 1 shown in FIG. 1. The system as described uses a single chip microprocessor. The operating codes may either be embedded in a microprocessor-resident memory, or in the alternative, the codes may be resident in one or more external read-only-memories (ROMs), which ROMs are popularly available as PROM or EPROM memory chips.

As discussed earlier the PWM modulation may be implemented in either hardware or software. A simplified circuit may be constructed using a custom digital logic chip, which while not a microprocessor per se, could operate in substantially the same way using a series of instructions and data in a read-only memory (ROM). These board-level variations are encompassed by the present invention.

There are many variations available to circuit designers to control the current through the LEDs. The PWM circuits could be replaced with a digital-to-analog converter driving a transistor, field-effect transistor, or some other forms of current control means, of which there are many different types known to workers skilled in the electrical arts.

Similarly, the present invention is not in any way limited to the particular choice of light emitting diodes (LEDs) described herein, and the novel inventive features described herein may be utilized with many different types of LEDs or other electric lamps.

It is therefore intended that the forgoing detailed description be regarded as illustrative rather than limiting, and that it be understood that it is the following claims, including all equivalents, which are intended to define the scope of this invention.

Doc. No.: CHLI-0001 PATENT

APPENDIX A: SOURCE CODE LISTINGS

Doc. No.: CHLI-0001 PATENT

```
#pragma DEBUG CODE symbols  small oe ot(6,size) LC

              /* added C8051 for the Intel / Phillips chip families */
/* file pwm.c */

/* Simulated Electronic Candle                                          */
/* copyright A. Chliwnyj 10/1/94   7/14/96 */
/*                                                                      */

/*************************************************************************/
/* all of the code is the same for hardware or code PWM with the exception   */
/* of the interrupt service routine and the interrupt rate                   */
/*************************************************************************/


#undef DBG

/*************************************************************************/
/* this is the ONLY section of this program that needs to change to support  */
/* different processors  */
/*************************************************************************/

/* uncomment one of the processor selections to compile for that processor */
 #define  C8051
/*  #define  DOS */
/* #define TI */


#define main_stor  /* to allocate storage when main is compiled */
 #include "fvars.h"   /* the global variables */


/* for DOS use the following includes */
#ifdef DOS
 #include "stdio.h"
 #include <stdlib.h>
 #include <math.h>
 #include "flame.h"    /* processor dependent support routines */
 #include "fsine.h"    /* the processor dependent support routines */
#endif

/* for TI processors use the following includes  */
#ifdef TI
 #include "flamet.h"   /* the processor dependent support routines */
 #include "fsinet.h"  /* the sine wave tables */
#endif

/* for 80C51 processors use the following includes  */
#ifdef C8051
#include <stdlib.h>           /* library for the 8051 standard functions  */
#include <absacc.h>           /* library for the 8051 memory access funct */
#include "seq0.h"    /* the wave sequences defined and initialized */
#include "seq1.h"    /* the wave sequences defined and initialized */
#include "seq2.h"    /* the wave sequences defined and initialized */
#include "flame50.h"   /* the processor dependent support routines */
#endif


/*************************************************************************/
/* these are the defines that need to be changed if the processor clock      */
```

Doc. No.: CHLI-0001 PATENT

```
/* frequency changes so that the speed of the simulation remains the same    */
#define rnd_mod  1 /* slow down if there sequence gets shorter or the */
#define base_mod 1 /* PWM circuits get faster it is all tied together */
/*****************************************************************************/

/*****************************************************************************/
/* subroutine to set all request flags                                       */
/*****************************************************************************/
void set_all_requests(void) {
        color[led0  ].New_Request = 1;
        color[led1  ].New_Request = 1;
        color[led2  ].New_Request = 1;
        color[led3  ].New_Request = 1;
        color[led4  ].New_Request = 1;
}
/*****************************************************************************/
/*****************************************************************************/
/*      this is the routine that changes the frequency of a LED            */
/*****************************************************************************/
void randomize_single_flame(void) {
#define min_freq 0  /* user preference */
#define rnd_top 11  /* limit the maximum frequency */

        color[led0  ].New_Frequency  = min_freq + random(rnd_top) ;
        color[led1  ].New_Frequency  = min_freq + random(rnd_top) ;
        color[led2  ].New_Frequency  = min_freq + random(rnd_top) ;
        color[led3  ].New_Frequency  = min_freq + random(rnd_top) ;
        color[led4  ].New_Frequency  = min_freq + random(rnd_top) ;

        color[led0  ].Current_sequence =  seq0;
        color[led1  ].Current_sequence =  seq2;
        color[led2  ].Current_sequence =  seq2;
        color[led3  ].Current_sequence =  seq2;
        color[led4  ].Current_sequence =  seq2;

        set_all_requests();  /* set all leds to requesting new frequency */
}


/*****************************************************************************/
/*      this is where the major mode of randomness is selected              */
/*****************************************************************************/

void  select_random_mode(void)   {
      /* there are two levels of selection to be made here */
      /* the first is the sequence and what randomness to use */
      /* the other is stillness and the wind effects */

/* the first thing to do is to delay before changing modes */

/* changine modes is also done as a function of the mode that we are in */
/* some modes need to change faster than others */

/*  The index takes on a value 0..6 to select one of the modes
    for the flame_mode variable

    manual, random_chg, list_seq, list_rnd, totally_rnd, seq_up, seq_dn
*/

/* here is where the flame mode is possibly changed depending on current mode */
```

```
    if (--pattern_done <=0 || pattern_done > 20) {     /* look to see if we need t
      switch (flame_mode) {
      case manual:        /* never change out of manual mode */
         break;
      case list_seq:     /* if in one of the list modes don't go random_chg */
      case list_rnd:
      case seq_up:
      case seq_dn:
        flame_mode = 2+random(4);  /* don't go into 0 manual mode */
        pattern_done = random(3); /* wait for a while to change */
         break;
      default:   /* the random modes go here */
        flame_mode = 1+random(5);  /* don't go into 0 manual mode */
        pattern_done = random(7); /* wait for a while to change */
         break;
      } /* endswitch */


  /*  The index takes on a value 0..5 to select one of the modes
      for the flame_stability variable

      still, wind, slow_bright, slow_dim, fast, soft
  */
      switch (flame_stability) {
      case wind:
          flame_stability = 1 + random(4);   /* choose a flame stability */
                /* don't go from wind back to wind and don't go still    */
         break;
      case fast:
          flame_stability = random(3);   /* choose a flame stability */
               /* if fast then make sure that it isn't fast again */
         break;
      default:
          flame_stability = random(2);   /* choose a flame stability */
          break;
      } /* endswitch */
    } /* endif */

  } /* end of the select_random_mode subroutine */

  /*****************************************************************************/
  /* this is the routine that changes sequences when the flame has stabilized  */
  /*****************************************************************************/
  void  select_sequence(void)   {

    signed char kk, jjj; /* temp variables */
    signed char i, col_indx; /* temp variables */
   /* change frequancies only when all pending changes have beeen met */

  switch (flame_mode) { /* do one of the random mode actions */

  case totally_rnd:
  default:
     {
             kk = 0; /* reset and look for a request still pending */

             for (jjj=0; jjj<number_of_LEDs; jjj++) kk += color[jjj ].New_Request;

        if (kk < 2) {      /*  some requests have been satisfied */
```

Doc. No.: CHLI-0001 PATENT

```
        for (col_indx = 0 ;col_indx < number_of_LEDs ;col_indx -+ ) {

            if (rand()%29*rnd_mod > color[col_indx   ].New_Frequency)
             i= 1; else i = -2;
            /* increment or decrement the frequency */
            color[col_indx   ].New_Frequency  += i;
            /* test the integrator limits and center the signal */
            if (color[col_indx   ].New_Frequency  >22*rnd_mod ) {
               color[col_indx   ].New_Frequency  = 2*rnd_mod ;
            } else {

              if (color[col_indx   ].New_Frequency  < 3*rnd_mod  )
                color[col_indx  ].New_Frequency  = 14*rnd_mod ;
            } /* endif */
        } /* endfor */

            color[led0  ].Current_sequence =  seq0;
            color[led1  ].Current_sequence =  seq0;
            color[led2  ].Current_sequence =  seq0;
            color[led3  ].Current_sequence =  seq0;
            color[led4  ].Current_sequence =  seq0;

            set_all_requests();  /* set all leds to requesting new frequency *

      #ifdef DOS
          show_parameters();   /* display what the change did */
      #endif

      select_random_mode(); /* setup to go to another mode */


      } /* change was made in this loop */
    }
    break;
  case random_chg:

  {
          kk = 0; /* reset and look for a request still pending */

          for (jjj=0; jjj<number_of_LEDs; jjj++) kk += color[jjj ].New_Request;


      if (kk < 3) {       /* most request flags are off ... LEDs at frequency */

       if (flame_change_delay++ >  2 ) {

          flame_change_delay = 0; /* restart the count */
          if (seq_loop++ > 2) {
              seq_loop = 0;

              color[led0  ].New_Frequency  =  5*base_mod + random(22*rnd_mod) ;
              color[led1  ].New_Frequency  =  6*base_mod + random(20*rnd_mod) ;
              color[led2  ].New_Frequency  =  4*base_mod + random(24*rnd_mod) ;
              color[led3  ].New_Frequency  =  6*base_mod + random(18*rnd_mod) ;
              color[led4  ].New_Frequency  =  5*base_mod + random(22*rnd_mod) ;

              color[led0  ].Current_sequence =  seq1;
              color[led1  ].Current_sequence =  seq1;
              color[led2  ].Current_sequence =  seq1;
```

```
            color[led3  ].Current_sequence =  seq1;
            color[led4  ].Current_sequence =  seq1;

            set_all_requests();  /* set all leds to requesting new frequency *
          } else {

           randomize_single_flame();      /* allow the flame to change */

          } /* endif */

        #ifdef DOS
            show_parameters();   /* display what the change did */
        #endif

        select_random_mode(); /* setup to go to another mode */

          } /* flame stability loop */


        } /* change was made in this loop */

      }
     break;
  case list_rnd:  /* randomly choose from a list of "good" patterns */
                  /* both list modes use common code */
  {
           kk = 0; /* reset and look for a request still pending */

           for (jjj=0; jjj<number_of_LEDs; jjj++) kk += color[jjj ].New_Request;


        if (kk < 3) {      /* most request flags are off ... LEDs at frequency */

         if (flame_change_delay++ >  2 ) {

            flame_change_delay = 0; /* restart the count */
            if (seq_loop++ > 2) {
                seq_loop = 0;

                color[led0  ].New_Frequency  =  5*base_mod + random(22*rnd_mod) ;
                color[led1  ].New_Frequency  =  6*base_mod + random(20*rnd_mod) ;
                color[led2  ].New_Frequency  =  4*base_mod + random(24*rnd_mod) ;
                color[led3  ].New_Frequency  =  6*base_mod + random(18*rnd_mod) ;
                color[led4  ].New_Frequency  =  5*base_mod + random(22*rnd_mod) ;

                color[led0  ].Current_sequence =  seq1;
                color[led1  ].Current_sequence =  seq1;
                color[led2  ].Current_sequence =  seq1;
                color[led3  ].Current_sequence =  seq1;
                color[led4  ].Current_sequence =  seq1;

                set_all_requests();  /* set all leds to requesting new frequency *
            } else {

             randomize_single_flame();      /* allow the flame to change */

            } /* endif */

         #ifdef DOS
            show_parameters();   /* display what the change did */
```

Doc. No.: CHLI-0001 PATENT

```
        #endif

        select_random_mode(); /* setup to go to another mode */

          } /* flame stability loop */


        } /* change was made in this loop */

      }
     break;
  case seq_up:    /* sequence from fast to slow */

            kk = 0; /* reset and look for a request still pending */

            for (jjj=0; jjj<number_of_LEDs; jjj++) kk += color[jjj ].New_Request;


        if (kk < 3) {       /* most request flags are off ... LEDs at frequency */

         if (flame_change_delay++ >  2 ) {

            flame_change_delay = 0; /* restart the count */

                color[led0  ].New_Frequency++;
                color[led1  ].New_Frequency += 3;
                color[led2  ].New_Frequency++;
                color[led3  ].New_Frequency += 2;
                color[led4  ].New_Frequency++;

                set_all_requests();  /* set all leds to requesting new frequency *

                select_random_mode(); /* setup to go to another mode */
                #ifdef DOS
                  show_parameters();   /* display what the change did */
                #endif
          }
        }
     break;

  case seq_dn:     /* sequence from slow to fast */
  case list_seq:  /* go through a sequential list of patterns */

             kk = 0; /* reset and look for a request still pending */

             for (jjj=0; jjj<number_of_LEDs; jjj++) kk += color[jjj ].New_Request;


        if (kk < 3) {       /* most request flags are off ... LEDs at frequency */
         if (flame_change_delay++ >  2 ) {

            flame_change_delay = 0; /* restart the count */

            if (color[led0  ].New_Frequency  > 2) color[led0  ].New_Frequency-= 2;
            if (color[led1  ].New_Frequency  > 3) color[led1 ].New_Frequency--;
            if (color[led2  ].New_Frequency  > 2) color[led2 ].New_Frequency--;
            if (color[led3  ].New_Frequency  > 2) color[led3  ].New_Frequency-= 2;
            if (color[led4  ].New_Frequency  > 6) color[led4  ].New_Frequency-= 5;
```

Doc. No.: CHLI-0001 PATENT

```
                set_all_requests();  /* set all leds to requesting new frequency *
                select_random_mode(); /* setup to go to another mode */
                #ifdef DOS
                  show_parameters();   /* display what the change did */
                #endif
            }
          }
      break;
   case manual: /* for manual tuning of pleasing sequences */
      break;


   } /* endswitch */
   }

   /*****************************************************************************/
   /*****************************************************************************/
   /*      this is the improved single table with parameters version            */
   /*      here is where the pointer sequences through the sinusoid             */
   /*      at a a rate determined by the prescaler divisor                      */
   /*****************************************************************************/
   /*****************************************************************************/

   void single_wave(void) {
   signed char ii;
   int overall_amplitude; /* for checking the overall current amplitude */


     switch ( flame_stability ) { /* depending on the stability sequence through th
                                  /* sequences in different ways....                */
                                  /* sometimes add some modulation                  */

        default:
     case still:
     case slow_bright:     /* these are all subsets of the still flame */
     case slow_dim:
     case soft:


     {     /* normal operation most of the time */
            overall_amplitude =0; /* reset for the loop */

            for (ii=0;ii < number_of_LEDs ;ii++ ) {

                  color[ii].Current_step--; /* count down */
               if (color[ii].Current_step <= 0) {
                  color[ii].Current_step  = color[ii ].Current_frequency;
                  color[ii ].Current_point++;
               }  /* the frequency divisor here */

             /* check to see if we are at the end of the sequence */
            if (color[ii ].Current_point  >= color[ii].Current_sequence_length )
            {
                color[ii].Current_point = 0; /* first wrap the buffer ptr */
                color[ii].Current_step  = color[ii].Current_frequency;

                /* check to see if there is a frequency change pending */

                if (color[ii].Current_frequency == color[ii].New_Frequency) {
                  color[ii].New_Request = 0; /* cancel pending */
```

Doc. No.: CHLI-0001 PATENT

```
                }

                if (color[ii].New_Request == 1) {
                  if (color[ii].New_Frequency > color[ii].Current_frequency)
                     color[ii].Current_frequency++; /* going up */
                   else color[ii].Current_frequency--; /* going down */
                }

            } /* end of sequence wrap check */

             /* finally get the current intensity from the table */
             color[ii].Current_intensity = (color[ii].Current_sequence[
             color[ii].Current_point]);

             /* make sure that the LED doesn't get any darker that we */
             /* allow for the current sequence */
        /*
         if (color[ii].Current_intensity<color[ii].Current_Min_allowed) {
            color[ii].Current_intensity=color[ii].Current_Min_allowed;
         }
       */

             /*  FLAME.overall_intensity */

            /* this next section needs to apply the rules for NIGHT and DAY */
            /* as well as scaling the sequence for the particular led */

            overall_amplitude += color[ii].Current_intensity;
            } /* endfor */
        }
        break;


    case wind:
    case fast:      /* fast is a subset of wind */

    {

    /* brief jitter for a few cycles then return back normal */

            overall_amplitude =0; /* reset for the loop */

            for (ii=0;ii < number_of_LEDs ;ii++ ) {

                  color[ii].Current_step--; /* count down */
               if (color[ii].Current_step <= 0) {
                  color[ii].Current_step  = color[ii ].Current_frequency;
                  color[ii ].Current_point++;
               }  /* the frequency divisor here */

             /* check to see if we are at the end of the sequence */
             if (color[ii ].Current_point  >= color[ii].Current_sequence_length )
             {
                 color[ii].Current_point = 0; /* first wrap the buffer ptr */
                 color[ii].Current_step  = color[ii].Current_frequency;

                 /* check to see if there is a frequency change pending */

                 if (color[ii].Current_frequency == color[ii].New_Frequency) {
                   color[ii].New_Request = 0; /* cancel pending */
```

Doc. No.: CHLI-0001 PATENT

```
            }

            if (color[ii].New_Request == 1) {
              if (color[ii].New_Frequency > color[ii].Current_frequency)
                 color[ii].Current_frequency += 3 ; /* going up */
               else color[ii].Current_frequency -= 5; /* going down */
            }

            /* using char 8 bit vars check for rollover */
            if (color[ii].Current_frequency > 250 |
                color[ii].Current_frequency < 0 )
            {
                 color[ii].Current_frequency = color[ii].New_Frequency;
                 color[ii].New_Request = 0;
            }

          } /* end of sequence wrap check */

           /* finally get the current intensity from the table */
           color[ii].Current_intensity= (color[ii].Current_sequence[
           color[ii].Current_point]);

           /* make sure that the LED doesn't get any darker than we */
           /* allow for the current sequence */

/* THIS SECTION IS USED WITH THE KEYBOARD INTERFACE TO MAKE THE FLAME DIM   */
/* BASED ON THE FLAME INTENSITY EVERY SO MANY SAMPES ARE SET TO ZERO        */
/* Night time power management will use this routine to conserve power      */
/* by inserting zeros to reduce power at the expense of apparent intensity  */
/* also has the effect of increasing the dynamic range of the LED intensity */

        if (flame_intensity > 1) {
          if ( (flame_hole++ % flame_intensity) != 1)
     /*   color[ii].Current_intensity=color[ii].Current_intensity/8; */
          color[ii].Current_intensity=0;
          if (flame_hole > 30177) flame_hole=0;
        }
           flame_hole++;
         /* increment the intensity modulation */

         overall_amplitude += color[ii].Current_intensity;
         } /* endfor */

     }
     break;
  } /* end of the switch */

#ifdef C8051
                  /* put the intensities in the register variables for */
                  /* far quicker PWM operation in assembly language    */
   DBYTE[0x8] = color[0].Current_intensity; /* using register Bank 1 */
   DBYTE[0x9] = color[1].Current_intensity; /* note absolute addresses */
   DBYTE[0xA] = color[2].Current_intensity;
   DBYTE[0xB] = color[3].Current_intensity;
   DBYTE[0xC] = color[4].Current_intensity;
#endif

} /* end of the single_wave subroutine */

/*****************************************************************************/
```

Doc. No.: CHLI-0001 PATENT

```
/*****************************************************************************/
/* THIS IS THE MAIN LOOP */
/*****************************************************************************/

main () {

   char main_flame_lenght;

   flame_mode = random_chg; /* to allow automatic random modes */

   flame_stability = still;/* start out with a still steady flame */
   flame_change_delay = flame_delay_value;
   flame_intensity = 1; /* 1 is full intensity greater numbers = less */

   exit_flag = 0 ;

   init_all_colors();    /* fill out the structures for each color limits */
                         /* with the initial starting conditions */
   seed_random_num();
                         /* here is were we select a random starting seed */
                         /* for the random number generator */

   exit_flag = 0; /* do not exit yet */
   j = 2;
   seq_loop = 0;


 /*****************************************************************************/
  grab_interrupt_vectors(); /* hook up to the timer interrupt */
                            /* setup the timer and enable ints */

 /*****************************************************************************/

/* small chages required for the DOS based version or standalone */
#ifdef DOS              /* this is the main infinite loop here */
  while (exit_flag == 0 ) {
#endif

#ifdef TI               /* this is the main infinite loop here */
  for (; ; ) {
#endif

#ifdef C8051            /* this is the main infinite loop here */
  PWM_LP_L = PWM_Loop_Length; /* define loop length as a const in a register */
  for (; ; ) {
#endif

 /*****************************************************************************/

    if (PWM_Loop_Flag ) {
     single_wave();   /* run the divisors and possible step through sine wave */
       PWM_Loop_Flag = 0; /* reset the flag that shows a PWM cycle ocurred */

     if (j++ >= 3 ) /* minimum delay value before allowing a change  */
      {
       j = 0 ;

       if (flame_mode > 0 ) { /* not in manual mode */

       select_sequence();   /* depending on the mode change the frequencies */
```

Doc. No.: CHLI-0001 PATENT

```
                                /* random_modes selects the type ......   */
        }

            }

          if ( kbhit()) user_interface(); /* if a key was hit find out what */
                                          /* operational only in DOS modes  */

         }

      } /* end while */
        /* operation has been terminated put things back to normal */
      /* restore to original interrupt routine */
    #ifdef DOS
      restore_vectors(); /* get back to dos */
      show_parameters();
      return 0;
    #endif
      /* end of main */
    }
```

Doc. No.: CHLI-0001 PATENT

```
/* file fvars.h */
/*****************************************************************************/
/* all of the global variables are defined here */
/* changed to define the storage only for the main program */
/* use externs for all the rest of the stuff */

/*****************************************************************************/
#define base_cnt 1  /* for screen debug to make this faster */
#define number_of_LEDs 5  /* limited to 5 LEDs due to processor limitations */

#define PWM_Loop_Length 64  /* here is where PWM in number of bits is */

/* this is how long the flame has to go before a change is allowed  */
/* currently this is used in the random mode only */
#define flame_delay_value 50  /* defined in sample points */

/* this does not have to be tied to the pwm loop length .... */
#define flame_len 64 /* define an overall flame length */

/* define the bit positions for the parallel I/O port */

#define led0   0
#define led1   1
#define led2   2
#define led3   3
#define led4   4

/* define the sequence lengths here */

# define seqNUM 3 /* number of available sequences */

#define seq0_len flame_len /* define the sequence lengths */
#define seq1_len flame_len /* define the sequence lengths */
#define seq2_len flame_len /* define the sequence lengths */
#define seq3_len flame_len /* define the sequence lengths */

/*****************************************************************************/
/*       define the types of flames that can be imitated                     */
/*****************************************************************************/
/*****************************************************************************/

/*  define some flame styles for use in variable flame_stability */

#define still       0  /* the default still flame */
#define wind        1
#define slow_bright 2
#define slow_dim    3
#define fast        4
#define soft        5 /* lots of different flame speeds */

/*  define some flame speeds for use in variable flame_mode */

#define manual        0    /* turn off any sequence changes */
#define random_chg    1    /* first stab at the random stuff */
#define list_seq      2    /* go through a list of stuff sequentially */
#define list_rnd      3    /* go through a set of good stuff randomly */
#define totally_rnd   4    /* randomly select stuff even if not settled */
#define seq_up        5    /* start fast and  increment  */
#define seq_dn        6    /* start slow and  decrement  */
```

Doc. No.: CHLI-0001 PATENT

```
/*****************************************************************************/
/*****************************************************************************/

/*****************************************************************************/
/*  this is a structure for dealing with all of the parameters of a single   */
/*  LED or set of LEDs for a given color
/*****************************************************************************/

 typedef struct
                {
        unsigned char
                        Current_intensity;
        unsigned char  *Current_sequence;
        signed char     Current_frequency,  /* delay between steps on wave */
                        Current_step,  /* where we are in the countdown */
                        Current_point; /* where we are in the waveform */
        unsigned char   Current_amplitude, /* in terms of PWM */

                        New_Request, /* change is pending do something */
                        New_Frequency, /* frequency target */

                        Current_sequence_length;  /* the lengthe of the seq */

                    }   color_parms_type;


/* this is a definition of the data structute for the overall flame type */

 typedef struct flame_type
        {
/*        unsigned char overall_intensity; */ /* crank up the whole thing */
        unsigned char step;   /* current substep of the envelope */
        unsigned char point;  /* current point in the waveform */
        unsigned char frequency; /* overall flame frequency */
      float *cur_seq ; /* current overall flame sequence */
        unsigned char sequence_length;
        unsigned char intensity;           /* overall intensity */
        }  flame_type_type;

/*****************************************************************************/
/*      define the system variables here                                     */
/*****************************************************************************/

#ifdef main_stor     /* only allocate the storage in the main routine */

 unsigned char j ; /* for mail loop delay timing */
 unsigned char pattern_done = 2;  /* count down to allow pattern change */
 unsigned char flame_intensity;           /* overall intensity */
 unsigned char flame_mode;      /* which mode are we operating in */
 unsigned char flame_stability; /* flicker or  none wind, still etc */
 int flame_change_delay; /* how long to wait before a change */

 int flame_hole = 0; /* for modulating the flame intensity in time */
 unsigned char exit_flag = 0 ;  /* for exiting the main loop */

 #ifdef C8051  /* don't reserve the storage for 8051 stuff */
 #else
 unsigned  char bits;    /* for holding the bits for outputting to the port */
 unsigned char PWM_loop;  /* the main PWM loop counter */
 #endif
```

Doc. No.: CHLI-0001 PATENT

```
unsigned char sequence_cntr; /* for going through the sequences */
unsigned char seq_loop; /* for going through the sequences */


#ifdef C8051
  bit PWM_Loop_Flag ;   /*  full PWM cycle completed in interrupt routine */

/*  data flame_type_type flame; */ /* define that mode of the flame */

  data color_parms_type color[number_of_LEDs]; /* tables for the individual LEDs

  /* make some register mapped vars here for the interrupt service routine */
  /* uses the registers on page one */
  data unsigned char PWM0 _at_ 0x8; /* define the intensity  R0 */
  data unsigned char PWM1 _at_ 0x9; /* define the intensity  R1 */
  data unsigned char PWM2 _at_ 0xA; /* define the intensity  R2 */
  data unsigned char PWM3 _at_ 0xB; /* define the intensity  R3 */
  data unsigned char PWM4 _at_ 0xC; /* define the intensity  R4 */
  data unsigned char PWM_cnt _at_ 0xD; /* re-define the PWM counter R5   */
  data unsigned char PWM_LP_L _at_ 0xE; /* define loop length as a const */

#else
 int PWM_Loop_Flag ;      /*  full PWM cycle completed in interrupt routine */
/* flame_type_type flame;  */ /* this is the real thing */
 color_parms_type color[number_of_LEDs]; /* tables for the individual LEDs */
#endif

/*****************************************************************************/

 unsigned char sel_seq[number_of_LEDs]; /* for holding the currently selected se
 unsigned char allowed_seq_num; /* how many are we using at a time */

/*****************************************************************************/
/* define some variables to put the sequences into and be able to use them   */
/*****************************************************************************/

#ifdef C8051
  unsigned char code seq3[seq3_len] ;
  float code flame_env1[flame_len] ; /* try and bulid an overall profile */
#else
  unsigned char seq0[seq0_len] ;  /* reserve some storage for the sequences */
  unsigned char seq1[seq1_len] ;
  unsigned char seq2[seq2_len] ;
  unsigned char seq3[seq3_len] ;
  float flame_env1[flame_len] ; /* try and bulid an overall profile */
#endif

/* unsigned char seq_LEN  []  = {seq0_len,seq1_len,seq2_len,seq3_len }; */

unsigned char selected_color = 0; /* the color we are modifying  in PC user mode

/*****************************************************************************/
/*****************************************************************************/
#else   /* provide the linkage to all of the variables */
/*****************************************************************************/
/*****************************************************************************/

extern unsigned char pattern_done;
extern unsigned char flame_intensity;
```

Doc. No.: CHLI-0001 PATENT

```
extern  unsigned char flame_mode;
extern unsigned char flame_stability;
extern int flame_change_delay;

extern int flame_hole;
extern unsigned char exit_flag;
extern unsigned  char bits;

extern unsigned char sequence_cntr;
extern unsigned char seq_loop;

extern unsigned char PWM_loop;

#ifdef C8051
  extern bit PWM_Loop_Flag ; /* full PWM cycle completed in interrupt routine */
  extern data flame_type_type flame;
  extern data color_parms_type color[number_of_LEDs];

  extern data unsigned char PWM0 ; /* define the intensity  R0 */
  extern data unsigned char PWM1 ; /* define the intensity  R1 */
  extern data unsigned char PWM2 ; /* define the intensity  R2 */
  extern data unsigned char PWM3 ; /* define the intensity  R3 */
  extern data unsigned char PWM4 ; /* define the intensity  R4 */
  extern data unsigned char PWM_cnt; /* re-define the PWM counter R5   */
  extern data unsigned char PWM_LP_L; /* define loop length as a const */

#else
  extern int PWM_Loop_Flag ;      /*  full PWM cycle completed in interrupt rout
  extern flame_type_type flame;
  extern color_parms_type color[number_of_LEDs];
#endif

extern unsigned char sel_seq[number_of_LEDs];
extern unsigned char allowed_seq_num;

#ifdef C8051
  extern   unsigned char code seq0[seq0_len] ;
  extern   unsigned char code seq1[seq1_len] ;
  extern   unsigned char code seq2[seq2_len] ;
  extern   unsigned char code seq3[seq3_len] ;
  extern   float code flame_env1[flame_len] ;
#else
  extern   unsigned char seq0[seq0_len] ;
  extern   unsigned char seq1[seq1_len] ;
  extern   unsigned char seq2[seq2_len] ;
  extern   unsigned char seq3[seq3_len] ;
  extern   float flame_env1[flame_len] ;
#endif

extern unsigned char selected_color;
/* extern unsigned char seq_LEN  []; */
#endif
/*****************************************************************************/
```

Doc. No.: CHLI-0001 PATENT

```
#pragma DEBUG CODE symbols small src ot(6,size) LC
/* file Flame50.c */

/* these are the processor dependent functions for the flame */
/* this file is for an 8051 type processor */


#define C8051

#include "flame50.h" /* the function prototypes */
#include "fvars.h"   /* the storage definition  */
#include <reg52.h>            /* special function register declarations   */
#include <stdlib.h>           /* library for the 8051 standard functions  */

/*****************************************************************************/
/*****************************************************************************/
/* here is where we define the output port for the PWM bits */

/* P0 already be defined by reg52.h */
sbit light0 = P0 ^ 0 ; /* define the LEDs as bits of the port */
sbit light1 = P0 ^ 1 ; /* define the LEDs as bits of the port */
sbit light2 = P0 ^ 2 ; /* define the LEDs as bits of the port */
sbit light3 = P0 ^ 3 ; /* define the LEDs as bits of the port */
sbit light4 = P0 ^ 4 ; /* define the LEDs as bits of the port */

/*****************************************************************************/
/* this function performs the random function by calling a library function */
/* and then using mod to get the nunber limited */

int random(int limit)     /* generate a random number function */
{
 int i;
 i = rand();
return(i % limit );
}

void seed_random_num(void)  /* reset the random number generator */
{
 /* setup the random number generator with a starting seed based on RAM */
   char i, *j,k;
   for (k=i;k< 44 ;k++ ) {
      i +=*j;
   } /* endfor */           /* make a random seed from contents of RAM */

 srand(i); /* seed for the random number generator */
}

/*****************************************************************************/
/*                executes each 250us @ 12 MHz Crystal Clock                 */
/* #define PERIOD     -250      */              /* 250 usec interrupt period
#define PERIOD_100   -100       /* 100 usec for 10 KHz interrupt rate  */
#define PERIOD_50    -75        /*  75 usec for 15 Khz interrupt rate  */
/*****************************************************************************/


void  grab_interrupt_vectors() /* hook up to the timer interrupt */
{
  /* setup the timer 0 interrupt */
  TH0 = PERIOD_100;                              /* set timer period
```

Doc. No.: CHLI-0001 PATENT

```
  TL0 = PERIOD_100;
  TMOD = TMOD | 0x02;                          /* select mode 2              */
  TR0 = 1;                                     /* start timer 0              */
  ET0 = 1;                                     /* enable timer 0 interrupt   */
  EA  = 1;                                     /* global interrupt enable    */
  /* additional setup stuff is here */
  P1  = 0xFF;                                  /* set port 1 to enable  input */
}

/*****************************************************************************/

/* define some bits for the user interface here */
/* P1 should already be defined by reg52.h */
sbit cntl0 = P1 ^ 0 ; /* define  */
sbit cntl1 = P1 ^ 1 ; /* define  */
sbit cntl2 = P1 ^ 2 ; /* define  */
sbit cntl3 = P1 ^ 3 ; /* flame_stability 1 = wind  */
sbit cntl4 = P1 ^ 4 ; /* sets the timer period for 12 - 24 MHz  */
sbit cntl5 = P1 ^ 5 ; /* 0 overrides the flame mode to manual  */
sbit cntl6 = P1 ^ 6 ; /* state defines flame mode  when keypressed  */
sbit cntl7 = P1 ^ 7 ; /* key pressed when low look at other bits  */

/*****************************************************************************/
int kbhit() {
/* the MSB in input port 1 is checked to see if we got a keypressed */
/* then the next bits are checked by user interface to see what it was */
if (cntl7 == 0) { /* look for a bit low  */
return(1); /* yep got a keypressed */
} else {
return(0); /* nope nothing happened */
} /* endif */
}

void user_interface() {
/* this gets the bits from the Input Port to set the mode */
/*
unsigned char modeset; /* intermediate to hold the bits of the port */
                       /* avoids bounce and stuff like that     */
   if (cntl6 == 1)                          /* msb sets the random mode */
                flame_mode = totally_rnd;
   else
                flame_mode = random_chg;

   if (cntl5 == 0)   /* next bit overrides the mode setting if on */
                flame_mode = manual; /* turn off any changes */


/*****************************************************************************/
/* this section deals with setting the clock divisor rate for different  */
/* crystals and applications */

   if (cntl4 == 1) {  /* this bit selects the clock divisor frequency */
    TH0 = PERIOD_100;
   } else {
    TH0 = PERIOD_50;   /* set timer period normal           */
   }
/*****************************************************************************/
/* this section deals with setting up the different flame modes
/*****************************************************************************/
   if (cntl3 == 1) {  /* this bit selects the wind / still setting */
```

Doc. No.: CHLI-0001 PATENT

```
        flame_stability = wind;
      } else {
        flame_stability = still;
      }
/*****************************************************************************/

} /* end of user_interface */

/*****************************************************************************/
/* HERE IS THE interrupt service routine for the  8051                       */
/*****************************************************************************/
/* PWM done in code for HWD PWM interrupt routine loads hard ware regs       */

/* Int Vector at 000BH, Reg Bank 1  */

timer0() interrupt 1 using 1
{
        if (PWM_cnt++ > PWM_LP_L) {
          PWM_cnt = 0;
          PWM_Loop_Flag = 1 ;  /* singnal main routine that we are done */
        }
          P0 = 0;        /* set all bits off  */
                         /* now turn on the ones you need */

          if (PWM0 > PWM_cnt) light0 = 1;
          if (PWM1 > PWM_cnt) light1 = 1;
          if (PWM2 > PWM_cnt) light2 = 1;
          if (PWM3 > PWM_cnt) light3 = 1;
          if (PWM4 > PWM_cnt) light4 = 1;
}

/*****************************************************************************/
/*****************************************************************************/
```

What is claimed is:

1. A microprocessor-based electronic flame simulation apparatus, comprising:

a plurality of electrical lighting circuits, each electrical lighting circuit comprising at least one lighting device having independently controlled light illumination;

a microprocessor for processing instructions and data representing output values for signal drivers to drive lighting devices in a realistic electronic flame simulation to generate a plurality of output signals;

microprocessor-based computer instruction programs and stored data cooperatively operating in and with said microprocessor to process data representing output values for signal drivers to drive a lighting device in a realistic electronic flame simulation;

a frequency reference source coupled to said microprocessor and providing an operating frequency reference for said microprocessor;

a plurality of signal drivers, each signal drivers being controlled by the respective one of said plurality of output signals and driving a corresponding lighting device; and DC electrical power source input terminals for connecting DC power to the electrical lighting circuits, microprocessor, and signal drivers.

2. The microprocessor-based electronic flame simulation apparatus of claim 1, wherein said microprocessor-based computer instruction programs and stored data cooperatively operating in and with the microprocessor comprises computer instruction programs with defined mode and waveform tables for effecting low-frequency intervals simulating a flame-pattern randomness and disturbances, individually and in concert.

3. The microprocessor-based electronic flame simulation apparatus of claim 2, wherein said microprocessor further comprises a set of microprocessor-resident integrated circuits for computing, processing, and generating a plurality of pulse width modulation output signals.

4. The microprocessor-based electronic flame simulation apparatus of claim 3, wherein said plurality of output signals are analog pulse width modulation output signals, each analog pulse width modulation output signal being coupled as a controlling input to a respective one of said plurality of signal drivers.

5. The microprocessor-based electronic flame simulation apparatus of claim 2, wherein said microprocessor-based computer instruction programs and stored data cooperatively operating in and with said microprocessor further computes, processes, and generates a plurality of digital pulse width modulation output data as said plurality of output signals.

6. The microprocessor-based electronic flame simulation apparatus of claim 5, wherein each of said plurality of signal drivers comprises a digital-to-analog converter.

7. The microprocessor-based electronic flame simulation apparatus of claim 6, wherein each of said plurality of signal drivers further comprises a linear current driver.

8. The microprocessor-based electronic flame simulation apparatus of claim 6, wherein said plurality of output signals is comprised of said plurality of digital pulse width modulation output data for digital input to each of said digital-to-analog converters.

9. The microprocessor-based electronic flame simulation apparatus of claim 2, wherein each of said plurality of electrical lighting circuits comprises a light emitting diode of individual illumination color and a series resistor.

10. The microprocessor-based electronic flame simulation apparatus of claim 9, further comprising a light diffuser to cover and diffuse lights emanating from said light emitting diodes.

11. The microprocessor-based electronic flame simulation apparatus of claim 2, wherein said lighting device is an incandescent lighting device.

12. The microprocessor-based electronic flame simulation apparatus of claim 11, further comprising a plurality of AC-powered triacs under individual AC conduction phase-angle triggering control by said microprocessor to individually drive said incandescent lighting devices.

13. The microprocessor-based electronic flame simulation apparatus of claim 2 further comprising a fireplace log-simulation comprising at least one simulated plastic log incorporating said electrical lighting circuits.

14. The microprocessor-based electronic flame simulation apparatus of claim 2 further comprising a programmed relaxation lighting device comprising a user input means and a user input means interface to provide an interface allowing for user input to control operation of the apparatus.

15. The microprocessor-based electronic flame simulation apparatus of claim 9, wherein said DC electrical power source providing a DC power comprises an AC-to-DC power converter electrically coupled to an internally-placed rechargeable battery pack, which AC-to-DC power converter derives its AC power from an external AC power source.

16. The microprocessor-based electronic flame simulation apparatus of claim 9, wherein said DC electrical power source providing a DC power comprises an AC-to-DC power converter deriving its AC power from an external AC power source.

17. The microprocessor-based electronic flame simulation apparatus of claim 16 further comprising a flame-simulation memorial candle, wherein said memorial candle comprises a standing base and a glass light-diffusing cover.

18. The microprocessor-based electronic flame simulation apparatus of claim 17, wherein said standing base has one or more recessed areas for personalized engravings.

19. The microprocessor-based electronic flame simulation apparatus of claim 17, wherein said glass light-diffusing cover has a decorative design etched in.

20. The microprocessor-based electronic flame simulation apparatus of claim 16 further comprising a flame-simulation decorative figure, wherein said high-brightness light emitting diodes serve as a simulated flame situated inside said flame-simulation decorative figure.

21. The microprocessor-based electronic flame simulation apparatus of claim 20, wherein said flame-simulation decorative figure is made of glass to achieve semi-transparent to translucent light diffusing qualities.

22. The microprocessor-based electronic flame simulation apparatus of claim 16 further comprising an urn for storage of cremated remains, wherein said light emitting diodes serve as a simulated-flame votive candle for said urn.

23. The microprocessor-based electronic flame simulation apparatus of claim 16 further comprising a self-contained flame-simulation light bulb with a standard base which mates with a socket of a standard lighting fixture, the self-contained flame-simulation light bulb enclosing the microprocessor-based electronic flame simulation apparatus.

24. The microprocessor-based electronic flame simulation apparatus of claim 23 further comprising a radio frequency interference shield situated inside said self-contained flame-simulation light bulb for effective shielding against internal electromagnetic emanations.

25. The microprocessor-based electronic flame simulation apparatus of claim 9, wherein said DC electrical power source providing a DC power comprises a low-voltage AC-to-DC power converter deriving its low-voltage AC power from an external low-voltage AC power source.

26. The microprocessor-based electronic flame simulation apparatus of claim 25 further comprising a candle fixture for placement as a lighted memorial on a front face of a prewired niche of a columbarium, which niche stores individual cremains.

27. The microprocessor-based electronic flame simulation apparatus of claim 26, wherein said candle fixture comprises a combination of a metal housing and one or more light diffusers, the candle fixture enclosing the microprocessor-based electronic flame simulation apparatus.

28. The microprocessor-based electronic flame simulation apparatus of claim 25 further comprising a candle fixture for placement as a lighted memorial on a front face of a prewired crypt of a mausoleum.

29. The microprocessor-based electronic flame simulation apparatus of claim 28, wherein said candle fixture comprises a combination of a metal housing and one or more light diffusers, the candle fixture enclosing the microprocessor-based electronic flame simulation apparatus.

30. The microprocessor-based electronic flame simulation apparatus of claim 25 further comprising a votive candle fixture for placement as a lighted memorial inside a prewired open-face style niche of a columbarium, the niche having a glass front.

31. The microprocessor-based electronic flame simulation apparatus of claim 10, wherein said DC electrical power source providing a DC power comprises one or more solar panels and one or more rechargeable and replaceable batteries.

32. The microprocessor-based electronic flame simulation apparatus of claim 31, wherein said microprocessor-based computer instruction programs and stored data cooperatively operating in and with the microprocessor further comprises computer instruction programs with stored data for effecting a microprocessor-controlled power management and illumination control by incorporating power budget estimates, electricity reserve capacity estimates, and measurements of time-dependent electricity discharge duration.

33. The microprocessor-based electronic flame simulation apparatus of claim 32 further comprising a low charge cutoff circuit.

34. The microprocessor-based electronic flame simulation apparatus of claim 32, further comprising a comparator to sense a solar-cell voltage and a battery voltage and derive a difference voltage.

35. The microprocessor-based electronic flame simulation apparatus of claim 32 further comprising a memorial for above-ground placement.

36. The microprocessor-based electronic flame simulation apparatus of claim 32 further comprising a memorial for in-ground placement.

37. The microprocessor-based electronic flame simulation apparatus of claim 6, wherein each of said plurality of signal drivers further comprises a linear voltage driver.

38. The microprocessor-based electronic flame simulation apparatus of claim 2 further comprising a fireplace log-simulation comprising at least one simulated ceramic log incorporating said electrical lighting circuits.

39. The microprocessor-based electronic flame simulation apparatus of claim 16 further comprising a flame-simulation memorial candle, wherein said memorial candle comprises a standing base and a plastic light-diffusing cover.

40. The microprocessor-based electronic flame simulation apparatus of claim 39, wherein said plastic light-diffusing cover has a decorative design etched in.

41. The microprocessor-based electronic flame simulation apparatus of claim 39, wherein said or plastic light-diffusing cover has a decorative design molded in.

42. The microprocessor-based electronic flame simulation apparatus of claim 17, wherein said glass light-diffusing cover has a decorative design molded in.

43. The microprocessor-based electronic flame simulation apparatus of claim 20, wherein said flame-simulation decorative figure is made of porcelain to achieve semi-transparent to translucent light diffusing qualities.

44. The microprocessor-based electronic flame simulation apparatus of claim 20, wherein said flame-simulation decorative figure is made of plastic to achieve semi-transparent to translucent light diffusing qualities.

45. A microprocessor-based electronic light pattern apparatus, comprising:

a plurality of electrical lighting circuits, each electrical lighting circuit comprising at least one lighting device having independently controlled light illumination;

a microprocessor for processing instructions and data representing output values for signal drivers to drive lighting devices in a relaxing light pattern to generate a plurality of output signals;

microprocessor-based computer instruction programs and stored data cooperatively operating in and with said microprocessor to process data representing output values for signal drivers to drive a lighting device in a relaxing light pattern;

a frequency reference source coupled to said microprocessor and providing an operating frequency reference for said microprocessor;

a plurality of signal drivers, each signal drivers being controlled by the respective one of said plurality of output signals and driving a corresponding lighting device; and DC electrical power source input terminals for connecting DC power to the electrical lighting circuits, microprocessor, and signal drivers.

46. The microprocessor-based electronic light pattern apparatus of claim 45, wherein said microprocessor-based computer instruction programs and stored data cooperatively operating in and with the microprocessor comprises computer instruction programs with defined mode and waveform tables for effecting low-frequency intervals to generate a relaxing light pattern having randomness and disturbances, individually and in concert.

47. The microprocessor-based electronic light pattern apparatus of claim 46 further comprising a user input means and a user input means interface to provide an interface allowing for user input to control light patterns generated by the apparatus.

* * * * *